US008348266B2

(12) United States Patent
Deno

(10) Patent No.: US 8,348,266 B2
(45) Date of Patent: Jan. 8, 2013

(54) SKEW-FEEDING CORRECTING APPARATUS AND IMAGE FORMING APPARATUS

(75) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/311,625

(22) Filed: Dec. 6, 2011

(65) Prior Publication Data

US 2012/0153565 A1 Jun. 21, 2012

(30) Foreign Application Priority Data

Dec. 15, 2010 (JP) ..... 2010-279228
Nov. 22, 2011 (JP) ..... 2011-255333

(51) Int. Cl.
*B65H 9/04* (2006.01)

(52) U.S. Cl. ..... 271/245; 271/246

(58) Field of Classification Search ..... 271/245, 271/246, 236, 226
See application file for complete search history.

(56) References Cited

U.S. PATENT DOCUMENTS

| | | | | |
|---|---|---|---|---|
| 5,873,664 | A * | 2/1999 | Umemo | 400/579 |
| 6,244,592 | B1 * | 6/2001 | Baba et al. | 271/243 |
| 7,722,039 | B2 * | 5/2010 | Shoji et al. | 271/273 |
| 7,823,879 | B2 * | 11/2010 | Vargas | 271/245 |
| 8,025,288 | B2 * | 9/2011 | Shoji et al. | 271/242 |
| 2005/0062220 | A1 * | 3/2005 | Cardillo et al. | 271/236 |
| 2008/0240821 | A1 | 10/2008 | Shoji et al. | |

FOREIGN PATENT DOCUMENTS

JP 2010-083649 4/2010

* cited by examiner

*Primary Examiner* — Kaitlin Joerger
(74) *Attorney, Agent, or Firm* — Fitzpatrick, Cella, Harper & Scinto

(57) ABSTRACT

The skew-feeding correcting apparatus of the present invention includes an abutment portion which is disposed to a conveying path to convey a sheet and to which a top end of the sheet is abutted to correct skew feeding of the sheet, a movement portion which moves the abutment portion in a sheet width direction perpendicular to a sheet conveyance direction, and a controller which controls driving of the movement portion to move the abutment portion to a position where a corner part of the sheet is not to be abutted to the abutment portion before the top end of the sheet is abutted to the abutment portion.

10 Claims, 26 Drawing Sheets

FIG. 11A

| ABUTMENT PIECE NUMBER | | S(-4) | S(-3) | S(-2) | S(-1) | S(1) | S(2) | S(3) | S(4) |
|---|---|---|---|---|---|---|---|---|---|
| ABUTMENT PIECE END POSITION | a( CENTER SIDE ) | -132.5 | -92.5 | -52.5 | -12.5 | 12.5 | 52.5 | 92.5 | 132.5 |
| | b( END SIDE ) | -147.5 | -107.5 | -67.5 | -27.5 | 27.5 | 67.5 | 107.5 | 147.5 |

FIG. 11B

| | SHEET WIDTH Lp | Lp/2 | NECESSITY DETERMINATION OF SHUTTER THRUST MOVEMENT ○: UNNECESSARY ×: NECESSARY | | | | DISTANCE FROM SHEET END | | SHUTTER MOVEMENT AMOUNT (MINIMUM REQUIRED MOVEMENT AMOUNT) |
|---|---|---|---|---|---|---|---|---|---|
| | | | S(1) | S(2) | S(3) | S(4) | a | b | |
| LATERAL A3 AND A4 | 297 | 148.5 | ○ | ○ | ○ | ○ | – | – | – |
| A4R | 210 | 105 | ○ | ○ | × | ○ | 12.5 | 2.5 | 12.5 |
| A5R | 148 | 74 | ○ | ○ | ○ | ○ | – | – | – |
| LATERAL B4 AND B5 | 257 | 128.5 | ○ | ○ | ○ | ○ | – | – | – |
| B5R | 182 | 91 | ○ | ○ | ○ | ○ | – | – | – |
| POSTCARD | 100 | 50 | ○ | ○ | ○ | ○ | – | – | – |
| LATERAL LDR AND LTR | 279.4 | 139.7 | ○ | ○ | ○ | × | 7.2 | 7.8 | 7.8 |
| LGL,LTR_R | 215.9 | 107.95 | ○ | ○ | ○ | ○ | – | – | – |
| STMT_R | 139.7 | 69.85 | ○ | ○ | ○ | ○ | – | – | – |
| EXE | 190.5 | 95.25 | ○ | ○ | × | ○ | 2.75 | 12.3 | 12.3 |
| 8K | 270 | 135 | ○ | ○ | ○ | × | 2.5 | 12.5 | 12.5 |
| 16K | 189.5 | 94.75 | ○ | ○ | × | ○ | 2.25 | 12.8 | 12.8 |
| 12" × 18" | 304.8 | 152.4 | ○ | ○ | ○ | ○ | – | – | – |
| 13" × 19.2" | 330.2 | 165.1 | ○ | ○ | ○ | ○ | – | – | – |
| SRA3 | 320 | 160 | ○ | ○ | ○ | ○ | – | – | – |

20mm
14mm
S
120
x
S(4)
S(3)
S(2)
S(1)
S(-1)
S(-2)
S(-3)
S(-4)
Li
Ls
0
$x_{3b}$=107.5
$L_p/2$=105
$x_{3a}$=92.5
$x_{2b}$=67.5
-$x_{2b}$=-67.5
-$x_{3a}$=-92.5
-$L_p/2$=-105
-$x_{3b}$=-107.5
$x_{3b}'$=121.5
$x_{3a}'$=106.5
$L_p/2$=105
$x_{2b}'$=81.5
-$x_{3a}'$=-78.5
-$x_{3b}'$=-93.5
-$L_p2$=-105
$x_{3b}''$=127.5
$x_{3a}''$=112.5
$L_p/2$=105
$x_{2b}''$=87.5
-$x_{2b}''$=-47.5
-$x_{3a}''$=-72.5
-$x_{3b}''$=-87.5
-$L_p/2$=-105

*FIG. 23A*

| SEPARATED ROLLER NUMBER | | S(-4) | S(-3) | S(-2) | S(-1) | S(1) | S(2) | S(3) | S(4) |
|---|---|---|---|---|---|---|---|---|---|
| SEPARATED ROLLER END POSITION | a( CENTER SIDE ) | -132.5 | -92.5 | -52.5 | -12.5 | 12.5 | 52.5 | 92.5 | 132.5 |
| | b( END SIDE ) | -147.5 | -107.5 | -67.5 | -27.5 | 27.5 | 67.5 | 107.5 | 147.5 |

FIG. 23B

| | SHEET WIDTH Lp | Lp/2 | NECESSITY DETERMINATION OF SEPARATED ROLLER MOVEMENT ○: UNNECESSARY ×: NECESSARY | | | | DISTANCE FROM SHEET END | | SEPARATED ROLLER MOVEMENT AMOUNT (MINIMUM REQUIRED MOVEMENT AMOUNT) | SEPARATED ROLLER MOVEMENT AMOUNT (MOVEMENT AMOUNT FOR SYMMETRIC ARRANGEMENT) |
|---|---|---|---|---|---|---|---|---|---|---|
| | | | S(1) | S(2) | S(3) | S(4) | a | b | | |
| LATERAL A3 AND A4 | 297 | 148.5 | ○ | ○ | ○ | ○ | – | – | – | – |
| A4R | 210 | 105 | ○ | ○ | × | ○ | 12.5 | 2.5 | 12.5 | 20 |
| A5R | 148 | 74 | ○ | ○ | ○ | ○ | – | – | – | – |
| LATERAL B4 AND B5 | 257 | 128.5 | ○ | ○ | ○ | ○ | – | – | – | – |
| B5R | 182 | 91 | ○ | ○ | ○ | ○ | – | – | – | – |
| POSTCARD | 100 | 50 | ○ | ○ | ○ | ○ | – | – | – | – |
| LATERAL LDR AND LTR | 279.4 | 139.7 | ○ | ○ | ○ | × | 7.2 | 7.8 | 7.8 | 20 |
| LGL,LTR_R | 215.9 | 107.95 | ○ | ○ | ○ | ○ | – | – | – | – |
| STMT_R | 139.7 | 69.85 | ○ | ○ | ○ | ○ | – | – | – | – |
| EXE | 190.5 | 95.25 | ○ | ○ | × | ○ | 2.75 | 12.3 | 12.3 | 20 |
| 8K | 270 | 135 | ○ | ○ | ○ | × | 2.5 | 12.5 | 12.5 | 20 |
| 16K | 189.5 | 94.75 | ○ | ○ | × | ○ | 2.25 | 12.8 | 12.8 | 20 |
| 12" × 18" | 304.8 | 152.4 | ○ | ○ | ○ | ○ | – | – | – | – |
| 13" × 19.2" | 330.2 | 165.1 | ○ | ○ | ○ | ○ | – | – | – | – |
| SRA3 | 320 | 160 | ○ | ○ | ○ | ○ | – | – | – | – |

SKEW-FEEDING CORRECTING APPARATUS AND IMAGE FORMING APPARATUS

BACKGROUND OF THE INVENTION

1. Field of the Invention

The present invention relates to a skew-feeding correcting apparatus which corrects skew feeding of a sheet and an image forming apparatus including the skew-feeding correcting apparatus.

2. Description of the Related Art

Typically, a skew-feeding correcting apparatus to correct skew feeding of a conveyed sheet to an image forming portion has been arranged for image formation without sheet-skewing by an image forming apparatus which forms an image on a sheet. In general, such a skew-feeding correcting apparatus corrects skew feeding of a sheet by correcting skew feeding at a top end of a sheet as abutting the top end of the sheet to a registration roller or a shutter and by conveying the sheet as nipping the top end with conveying rollers while keeping the state thereof. U.S. Publication No. 2008/0240821 discloses a structure in which an abutment member having abutment faces separated plurally in a width direction is arranged at the downstream side of nipping rollers. With this structure, when a sheet is skew-fed, skew feeding of the sheet is corrected as one end of a top end of the sheet being abutted to any of the abutment faces of the abutment member after the top end of the sheet passes between the separated nipping rollers and as the other end being abutted to another abutment face with swinging about the one end. Then, the sheet of which skew feeding is corrected is conveyed to the downstream side as the top end of the sheet being nipped by the nipping rollers. Further, Japanese Patent Laid-Open No. 2010-83649 discloses a structure in which a plurality of pairs of registration rollers having a first registration roller and a second registration roller respectively is arranged in an axial direction. With this structure, when a sheet is skew-fed, skew feeding of the sheet is corrected as one end of a top end of the sheet being abutted to a nip of any of the pairs of registration rollers and as the other end being abutted to a nip of another pair of registration rollers with swinging about the one end. Then, the sheet of which skew feeding is corrected is conveyed to the downstream side with rotation of the pair of registration rollers.

However, with the above-mentioned skew-feeding correcting apparatuses, there may be a case that a skew-feeding correction error occurs with corner creasing caused by buckling at a corner part of the sheet when the top end of the sheet to be conveyed is abutted to the abutment face or the nip of the pair of registration rollers from the corner part of the sheet.

In particular, recently, in a case that sheets are conveyed at high speed to increase productivity of an image forming apparatus (i.e., the number of image-formed sheets per unit time), sheet top ends are more likely to be damaged owing to large impact at the time of abutting of the sheet top ends to the abutment face or the nip of the pair of registration rollers. Further, recently, a variety of types of sheets (e.g., sheets having various basis weights and sizes and sheets having surface treatment performed like coating) have been used. Sheets having low stiffness (e.g., thin paper of which basis weight is 50 g/mm$^2$ or less) is more likely to be damaged when sheet top ends are abutted to the abutment face or the pair of registration rollers.

SUMMARY OF THE INVENTION

To address the above issues, the present invention provides a skew-feeding correcting apparatus capable of suppressing a skew-feeding correction error phenomenon with corner creasing caused by buckling of a sheet when the sheet is abutted to an abutment portion.

The skew-feeding correcting apparatus includes abutment portions which are disposed to a conveying path to convey a sheet and to which a top end of the sheet is abutted to correct skew feeding of the sheet, a movement portion which moves the abutment portions in a sheet width direction perpendicular to a sheet conveyance direction, and a controller which controls the movement portion based on a dimension in the width direction of the sheet to be conveyed to prevent a corner part of the sheet from being abutted to any of the abutment portions before the sheet is abutted to the abutment portions.

Further features of the present invention will become apparent from the following description of exemplary embodiments with reference to the attached drawings.

BRIEF DESCRIPTION OF THE DRAWINGS

FIG. 11A is a table indicating relation between an abutment piece number and abutment piece end positions, and FIG. 11B is a table indicating necessity determination of movement and a movement amount in a sheet width direction M of the shutter 121 for each sheet width of sizes of popular sheets S listed therein;

FIG. 23A is a table indicating relation between a separated roller number and separated roller end positions, and FIG. 23B is a table indicating necessity determination of movement and a movement amount in the sheet width direction M of the pair of registration rollers for each sheet width of sizes of popular sheets listed therein.

DESCRIPTION OF THE EMBODIMENTS

In the following, embodiments of the present invention will be described in detail based on examples in an exemplifying manner with reference to the drawings. Here, since dimensions, materials, shapes, relative positions thereof, and the like of structural components described in the embodiments are to be appropriately varied corresponding to a configuration of an apparatus to which the present invention is applied and various conditions, the scope of the present invention is not intended to be limited thereto unless otherwise specified specifically.

<First Embodiment>

Figure 1:
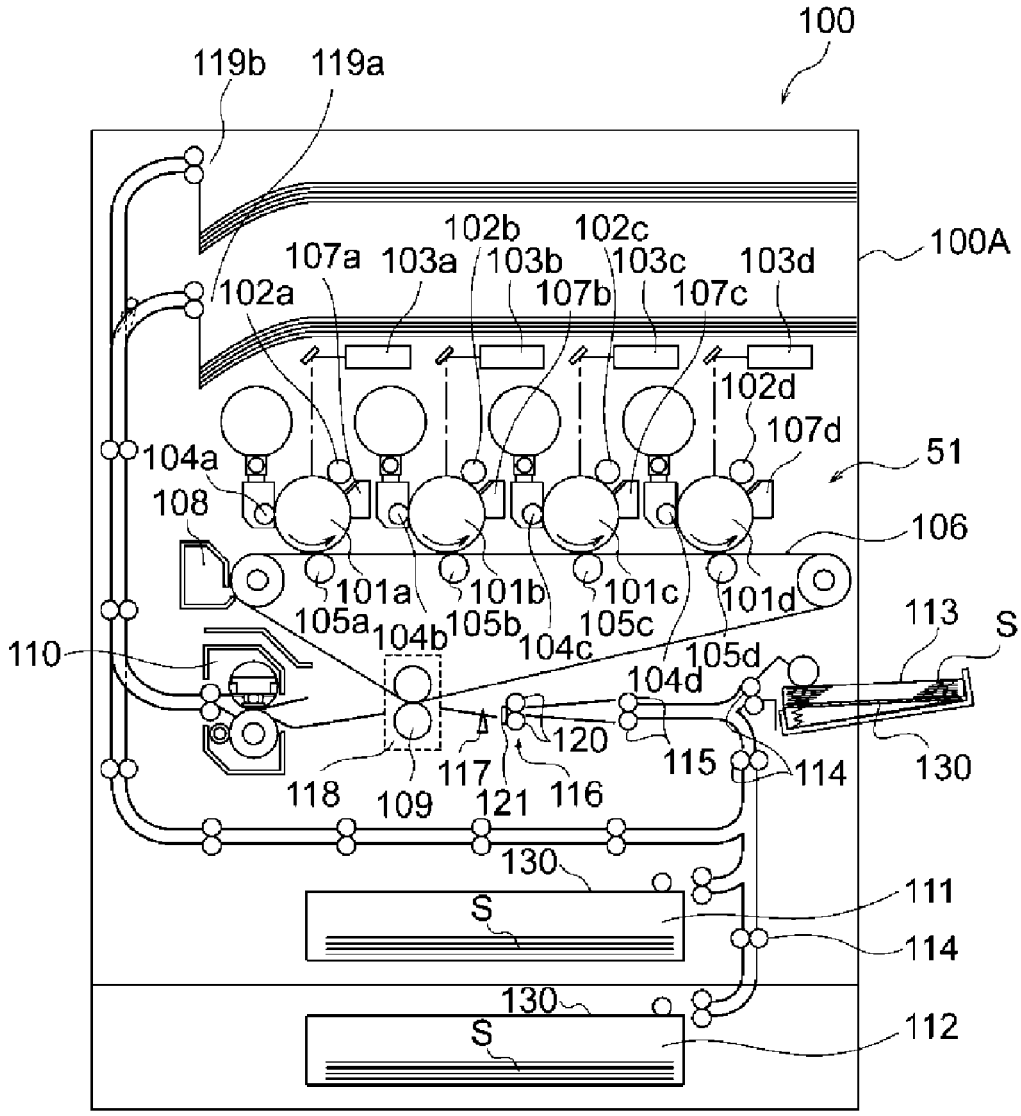
FIG. 1 is a sectional view illustrating a structure of an image forming apparatus which includes a skew-feeding correcting apparatus according to a first embodiment of the present invention.

FIG. 1 is a sectional view illustrating a structure of an image forming apparatus 100 which includes a skew-feeding correcting apparatus 116 according to a first embodiment of the present invention. The image forming apparatus 100 has a duplex printing function utilizing an electrophotographic image forming process. Here, a color digital printer is exemplified as the image forming apparatus. As illustrated in FIG. 1, the image forming apparatus 100 includes an image forming apparatus body (hereinafter, simply called an apparatus body) 100A. An image forming portion 51 which forms an image is disposed to the inside of the apparatus body 100A. The image forming portion 51 includes a photosensitive drum 101 being an image bearing member, and a primary transfer roller 105 being a transfer apparatus. At least the photosensitive drum 101 may be included in a process cartridge and assembled into the apparatus body 100A as the process cartridge.

At the inside of the apparatus body 100A, four photosensitive drums 101*a* to 101*d* are charged with even charges on surfaces thereof by charging rollers 102*a* to 102*d*, respectively. Image signals of yellow (Y), magenta (M), cyan (C) and black (K) are input to laser scanners 103*a* to 103*d*, respectively. The photosensitive drums 101*a* to 101*d* are irradiated with laser light on the surfaces thereof corresponding to the image signals, so that electrostatic images are formed as neutralizing the charges. The electrostatic images formed on the photosensitive drums 101*a* to 101*d* are developed with toner of yellow, magenta, cyan, and black, respectively. Each toner developed on the photosensitive drums 101*a* to 101*d* are sequentially transferred to an intermediate transfer belt 106 being an endless-belt image bearing member by the primary transfer rollers 105*a* to 105*d*, respectively. Thus, a toner image of full color is formed on the intermediate transfer belt 106.

A sheet feeding portion to feed a sheet is placed below the image forming portion 51. Sheet cassettes 111, 112 being sheet storage portions disposed to the sheet feeding portion store sheets S to be fed to the image forming portion 51. A manual feeding portion 113 is placed at a side part of the image forming apparatus and sheets S can be stacked on a tray being a sheet storage portion. The sheet S being receiving material such as recording paper fed from one of the sheet cassettes 111, 112 and the manual feeding portion 113 is conveyed toward a skew-feeding correcting apparatus 116 by a pair of conveying rollers 114 and a pair of pre-registration rollers 115 being a first conveying portion. The skew-feeding correcting apparatus 116 includes a shutter 121 which corrects skew feeding of the sheet S having a top end of the sheet S abutted thereto. Further, the skew-feeding correcting apparatus 116 may include a pair of registration rollers 120 being a second conveying portion.

Figure 2:
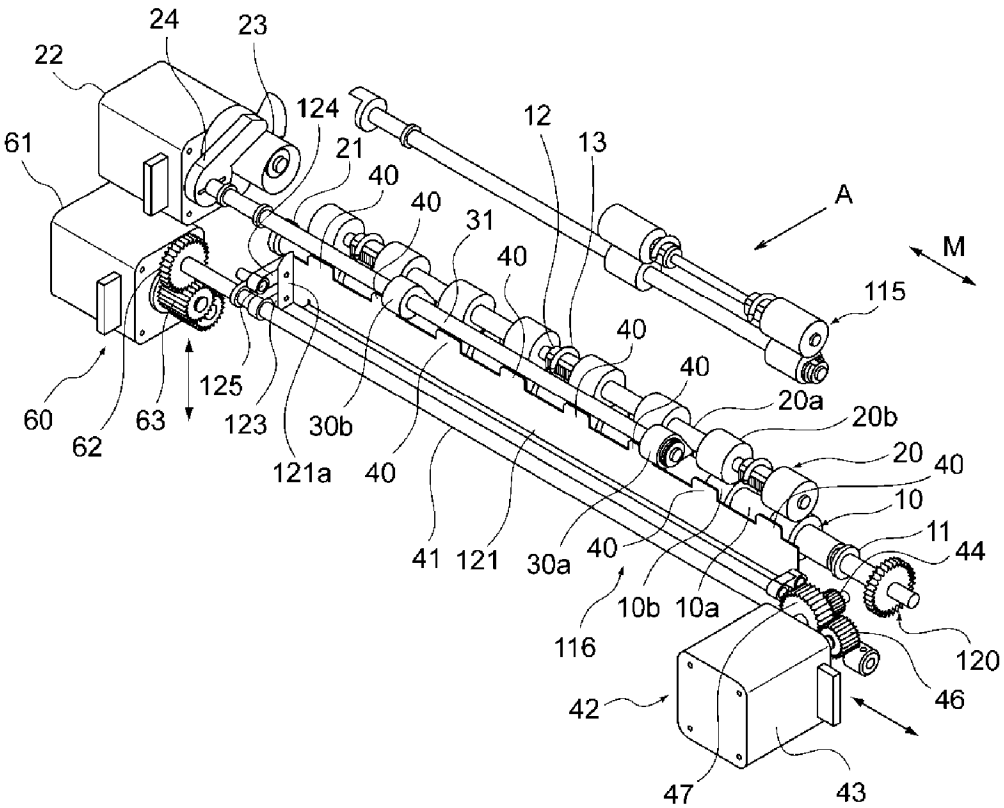
FIG. 2 is a perspective view illustrating a structure of the skew-feeding correcting apparatus.

The shutter 121 is arranged to be capable of being protruded and retracted against a conveying path which conveys the sheet S. Further, as illustrated in FIG. 2, the shutter 121 includes abutment pieces 40 as abutment portions. A plurality of the abutment pieces 40 is formed in a pectinate shape as being separated in a direction perpendicular to a conveyance direction. The abutment pieces 40 block the conveying path and the top end of the sheet S in the sheet conveyance direction A is abutted thereto, so that skew feeding of the sheet S is corrected. The pair of registration rollers 120 being the conveying portion is a pair of rollers which convey the sheet S in the sheet conveyance direction A. The above-mentioned shutter 121 is placed at the downstream side from the pair of registration rollers 120 in the sheet conveyance direction A. Here, the shutter 121 may be placed at the upstream side from the pair of registration rollers 120 in the sheet conveyance direction A. Details of the structure of the skew-feeding correcting apparatus 116 and skew-feeding correcting operation will be described below.

The sheet S of which skew feeding is corrected as being abutted to the shutter 121 is conveyed by the pair of registration rollers 120. The top end of the sheet S is detected by a registration sensor 117 after passing through the shutter 121. A controller 50 (see FIG. 6) being a controller calculates speed of the pair of registration rollers 120 corresponding to detection timing of the registration sensor 117 so that a top end of the image formed on the intermediate transfer belt 106 and the top end of the sheet S are matched at a secondary transfer portion 108. Then, the pair of the registration rollers 120 is rotated at the calculated speed to convey the sheet S.

The toner image on the intermediate transfer belt 106 is transferred to the sheet S by a secondary transfer outer roller 109 and is fixed on the sheet S as being heated and pressurized at a fixing apparatus 110. Subsequently, the sheet S is discharged to the outside of the apparatus body 100A from a discharge portion 119*a* or a discharge portion 119*b*.

Figure 6:
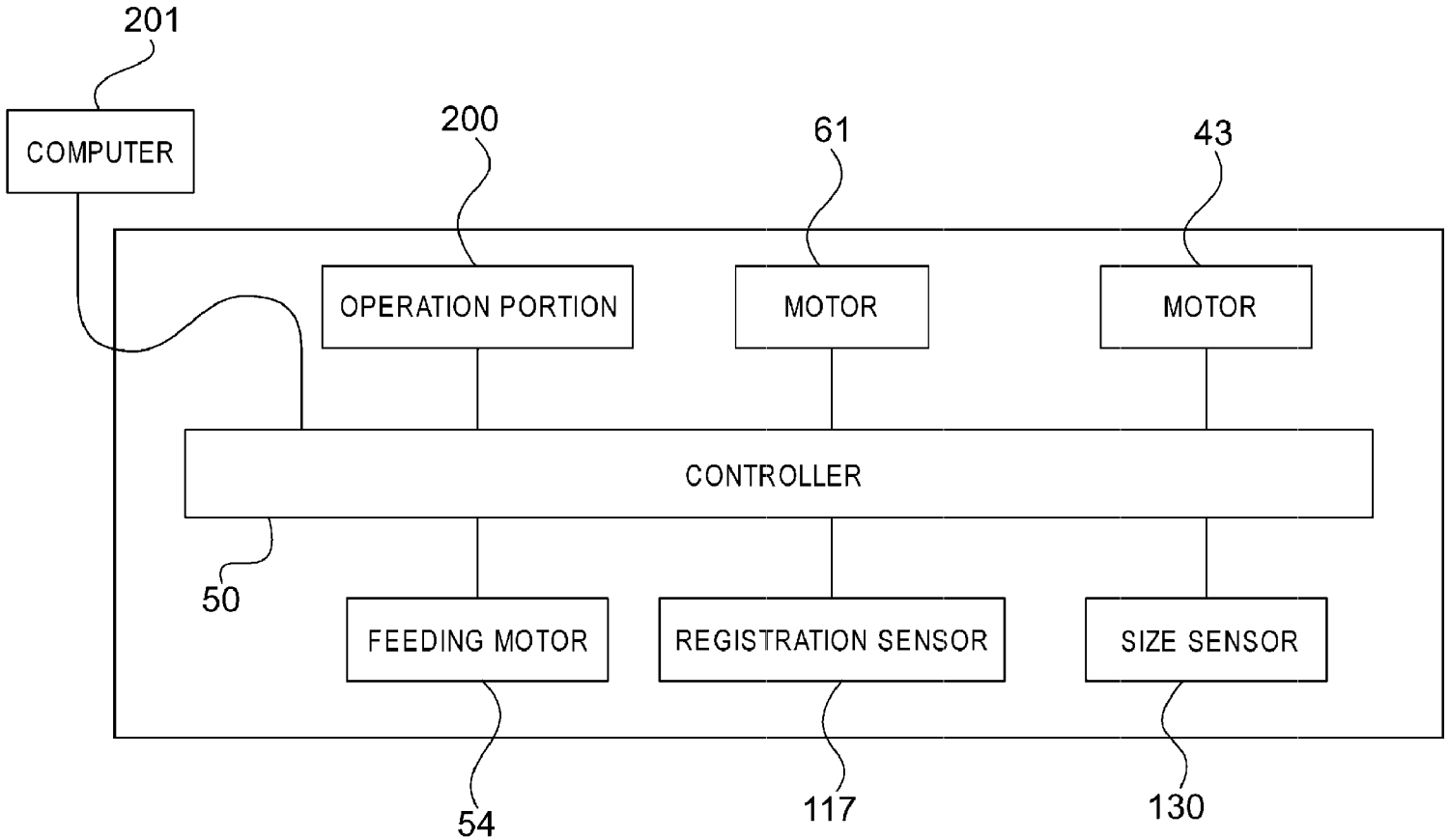
FIG. 6 is a block diagram illustrating a connection state among a controller and peripheral devices thereof.

Incidentally, to record an image in an appropriate range of the sheet S to be fed from the sheet cassette 111, 112 or the manual feeding portion 113, it is required that the apparatus body 100A acknowledges a size of the stored sheet S. The sheet cassettes 111, 112 and the manual feeding portion 113 each include a size detection portion 130 (as illustrated in FIG. 6). The size detection portion 130 detects the size of the sheet S at the inside of the sheet cassette 111, 112 or on the tray of the manual feeding portion 113.

A structure of the size detection portion 130 disposed to the sheet cassettes 111, 112 will be described in the following. The size detection portion 130 having a general structure includes a rotatable size detection lever in an interlocked manner as being slidably contacted to a width restriction plate which restricts a position of the sheet S in a width direction. Further, the size detection portion 130 includes a plurality of sensors or switches placed at positions corresponding to the size detection lever at an attaching portion where the sheet cassette 111, 112 is attached. When the width restriction plate is moved as being aligned to a side end of the sheet S, the size detection lever is rotated as being interlocked therewith. Subsequently, when the sheet cassette 111, 112 is attached to the attaching portion of the apparatus body 100A, the size detection lever performs ON/OFF operation selectively on detection elements of the sensors or switches placed at the attaching portion where the sheet cassette 111, 112 is attached. Accordingly, a signal having a different pattern is transmitted from the sensors or the switches to the controller 50 (see FIG. 6) at the inside of the apparatus body 100A. Then, the controller 50 acknowledges the size of the sheet S stored in the sheet cassette 111, 112 based on the signal. In a similar way, a similar size detection portion can be disposed to the manual feeding portion 113. Here, description thereof will not be repeated.

FIG. 2 is a perspective view illustrating a structure of the skew-feeding correcting apparatus 116. For simplicity, a sheet conveying guide is not illustrated in FIG. 2. As illustrated in FIG. 2, the skew-feeding correcting apparatus 116 includes the pair of registration rollers 120. The pair of registration rollers 120 includes a lower roller 10 and an upper roller 20 rotatably supported by a bearing 11 and a bearing 21 at the vicinities of both ends. The lower roller 10 and the upper roller 20 are arranged as being mutually opposed. A spring 13 is applied to each of the plural bearings 12 disposed to the upper roller 20. The upper roller 20 performs pressurizing as being pressed to the lower roller 10 with urging force of the spring 13. Thus, a nip is formed by the lower roller 10 and the upper roller 20.

In the lower roller 10, a plurality of rubber rollers 10*b* is integrally formed with a metal shaft 10*a* in the longitudinal direction. Here, the outer diameter of the rubber rollers 10*b* is 20 mm. In the upper roller 20, rollers 20*b* made of polyacetal resin are integrally formed around a metal shaft 20*a* so as to be faced to the rubber rollers 10*b* formed at the lower roller 10. The outer diameter of the rollers 20*b* is 20 mm, as well.

An eccentric cam 23 is fixed to a rotation shaft of a motor 22. Separation levers 30*a*, 30*b* are fixed to a rotation shaft 31 which is supported rotatably. Further, a cam follower 24 slidably contacted to the eccentric cam 23 is fixed to an end of the rotation shaft 31. The separation levers 30*a*, 30*b* are arranged to be placed below the metal shaft 20*a* of the upper roller 20. When the motor 22 is driven, the eccentric cam 23 is rotated, and then, the rotation shaft 31 is rotated as the cam follower 24 being pushed up. Owing to the rotation of the rotation shaft 31, the separation lever 30*a* and the separation lever 30*b* are rotated so as to push up the upper roller 20 against the urging force of the spring 13 which is applied to the upper roller 20. Nipping of the pair of registration rollers 120 can be released by this operation.

A shutter 121 is arranged along a sheet width direction M being a direction perpendicular to the sheet conveyance direction A at the downstream side from the pair of registration rollers 120 in the sheet conveyance direction A. The shutter 121 is formed of a metal plate having a plurality of abutment pieces 40 to which the top end of the sheet S abuts along the longitudinal direction.

Figure 5A:
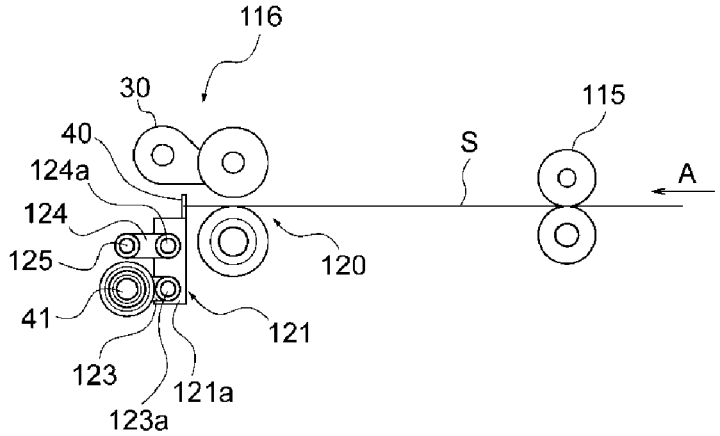
FIGS. 5A to 5C are side views illustrating the positional relation between the shutter and the sheet.
Figure 5B:
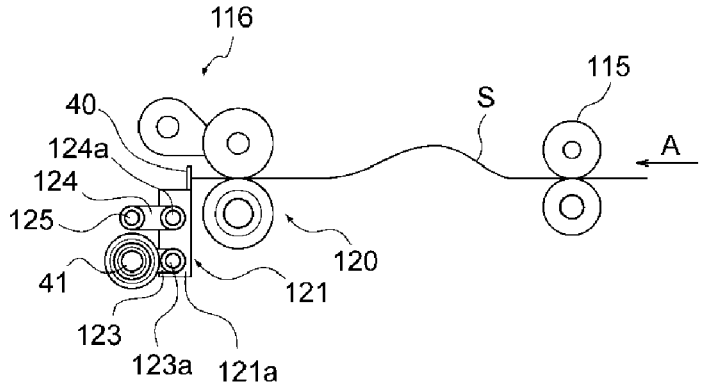
Figure 5C:
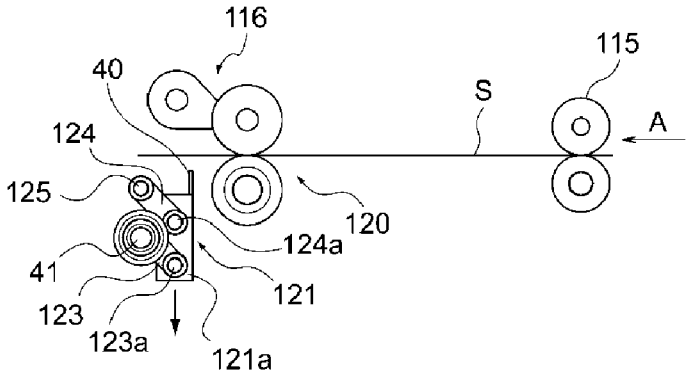

The skew-feeding correcting apparatus 116 includes a vertical movement apparatus 60 being a vertical movement mechanism which moves the shutter 121 in the vertical direction and a horizontal movement apparatus 42 being a horizontal movement mechanism which moves the shutter 121 in the sheet width direction M. Here, the vertical movement apparatus 60 is described. A gear 62 fixed to an end of a drive shaft 41 is engaged with a gear 63 attached to a rotation shaft of a motor 61. The drive shaft 41 is supported movably in the sheet width direction M. The gear 63 has a shape elongated in the axial direction so as to maintain the engaged state with the gear 62 even when the drive shaft 41 is moved in the sheet width direction M. Here, a mechanism of vertical movement of the shutter 121 is further described with reference to FIGS. 5A to 5C. As illustrated in FIGS. 5A to 5C, the shutter 121 includes a bent piece portion 121*a*. A link 123 is attached to the drive shaft 41 and a shaft 123*a* disposed to the bend piece portion 121*a*. Further, a link 124 is attached to a shaft 124*a* disposed to the bent piece portion 121*a* and a shaft 125 disposed to the apparatus body 100A. A parallel linkage is structured with the bent piece portion 121*a*, the link 123 and the link 124. The bent piece portion 121*a* is supported by the parallel linkage as being vertically movable in a parallel manner. When the drive shaft 41 is rotated clockwise in FIG. 5A, the link 123 is moved toward a lower side of the drive shaft 41 and the shutter 121 connected to the link 123 is moved downward. On the contrary, when the drive shaft 41 is rotated counterclockwise in FIG. 5C, the link 123 is moved toward an upper side of the drive shaft 41 and the shutter 121 is moved upward, as illustrated in FIG. 5A. In this manner, the shutter 121 can be protruded to and retracted from the conveying path which conveys the sheet S by being vertically moved in accordance with a rotation direction of the motor 61.

Figure 9:
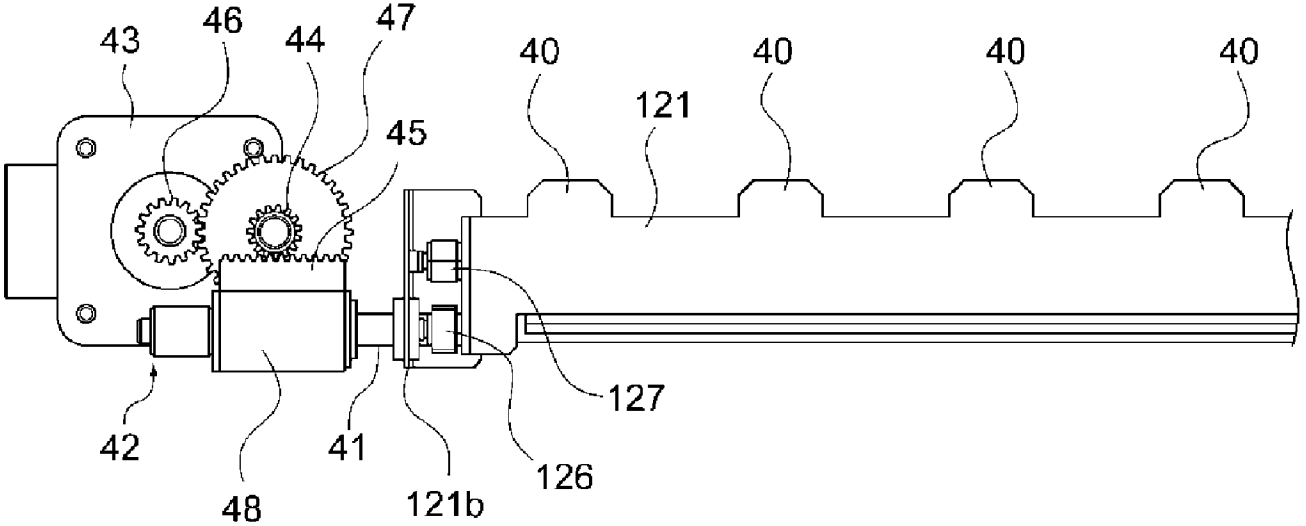
FIG. 9 is a front view illustrating a structure of a horizontal movement apparatus.

Here, the horizontal movement apparatus 42 being a movement portion is described with reference to FIG. 2 and FIG. 9 which is a view illustrating the horizontal movement apparatus 42 viewed from the upstream side in the sheet conveyance direction A. The horizontal movement apparatus 42 moves the abutment pieces 40 of the shutter 121 in the sheet width direction M which is perpendicular to the sheet conveyance direction A. The horizontal movement apparatus 42 includes a motor 43, a gear 46 attached to a rotation shaft of the motor 43, a gear 47 engaged with the gear 46, and a pinion gear 44 having less number of teeth than the gear 47 as being attached to the rotation shaft being common to the gear 47. Further, the horizontal movement apparatus 42 includes a rack 45 (see FIG. 9) engaged with the pinion gear 44, and a support member 48 (see FIG. 9) which supports the rack 45. The drive shaft 41 is rotatably inserted to the inside of the support member 48. However, the drive shaft 41 and the support member 48 are fixed in the axial direction (i.e., the sheet width direction M). Accordingly, although the drive shaft 41 can be rotated against the support member 48, movement of the support member 48 in the axial direction moves the drive shaft 41 as well in the axial direction. When the motor 43 is driven, the gear 46 at the rotation shaft of the motor 43 is rotated and the gear 47 engaged with the gear 46 is rotated. The pinion gear 44 is rotated owing to the rotation of the gear 47, so that the rack 45, the support member 48 and the drive shaft 41 are integrally moved in the sheet width direction M. In this manner, the shutter 121 can be moved in the sheet width direction M owing to movement of the rack 45 and the support member 48 in the sheet width direction M. Here, the teeth width of the gear 63 (i.e., an idler gear) is set to be wider than that of the gear 62 (i.e., a shutter input gear) (see FIG. 2). This is to enable protruding operation and retracting operation of the shutter 121 as maintaining gear engagement even when the shutter 121 and the gear 62 are moved in the sheet width direction M.

Figure 3:
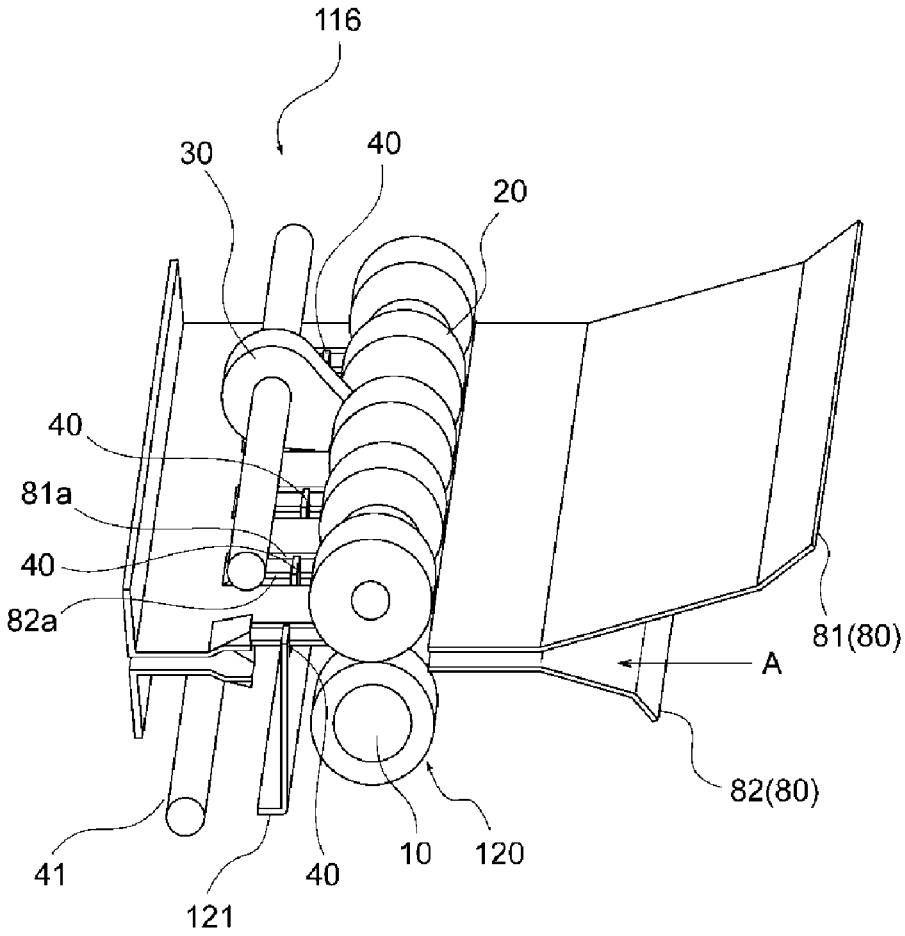
FIG. 3 is an enlarged perspective view illustrating the structure of the skew-feeding correcting apparatus.

FIG. 3 is an enlarged perspective view illustrating a structure of the skew-feeding correcting apparatus 116. FIG. 3 is a view illustrating the pair of registration rollers 120 in FIG. 2 viewed from another direction. FIG. 3 illustrates a conveying guide 80. As illustrated in FIG. 3, the conveying guide 80 includes an upper guide 81 and a lower guide 82. A guide gap formed between the both is set to 2 mm. To enable entering of the plurality of abutment pieces 40 formed in a pectinate shape, cutout 81*a* is formed at the upper guide 81 and cutout 82*a* is formed at the lower guide 82. By structuring as described above, vertical fluttering of the sheet S abutted to the shutter 121 can be suppressed between the upper guide 81 and the lower guide 82.

To obtain reliable abutment of the sheet S to the abutment pieces 40, sliding ability between the sheet S and the shutter 121 is required to be improved. Therefore, a friction coefficient of a surface of the shutter 121 can be low. Further, to prevent buckling (e.g., creasing, floating and the like) at the top end of the sheet S at the time when the sheet S is abutted to the shutter 121, the pair of registration rollers 120 and the shutter 121 are placed as close as possible. Such a buckling phenomenon is noticeable especially with paper having low stiffness such as thin paper. In the present embodiment, the distance between the pair of registration rollers 120 and the shutter 121 is set to be 12 mm to prevent the phenomenon.

When skew feeding of the sheet S is to be corrected, the shutter 121 is required to protrude the abutment pieces 40 to the conveying path for the sheet S. Further, when the sheet S is to be conveyed to the image transfer portion at the downstream side, the shutter 121 is required to retract the abutment pieces 40 from the conveying path. Accordingly, in the skew-feeding correcting apparatus 116, the shutter 121 is moved by the vertical movement apparatus 60. Protrusion and retraction of the abutment pieces 40 against the conveying path is performed with movement of the shutter 121 caused by rotating the drive shaft 41 forwardly or backwardly as driving the motor 61 of the vertical movement apparatus 60.

Figure 4A:
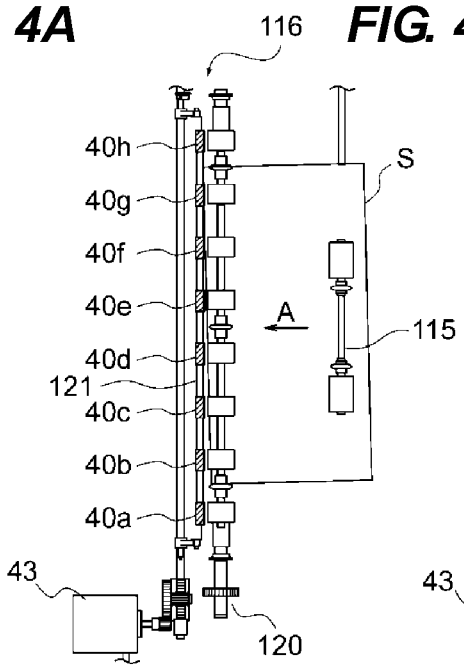
FIGS. 4A to 4C are plane views illustrating a positional relation between a shutter and a sheet.
Figure 4B:
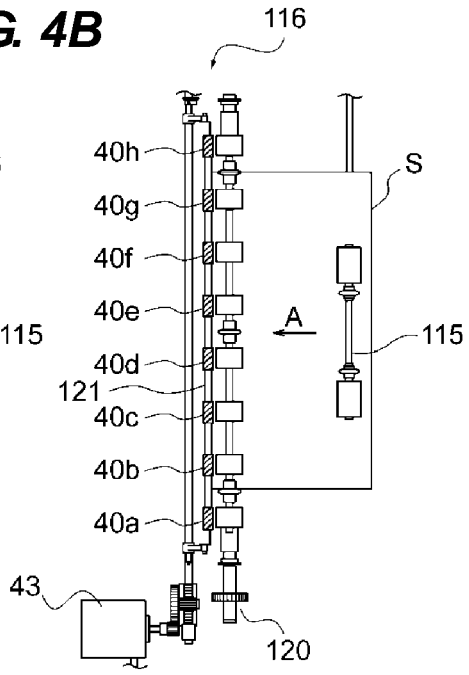
Figure 4C:
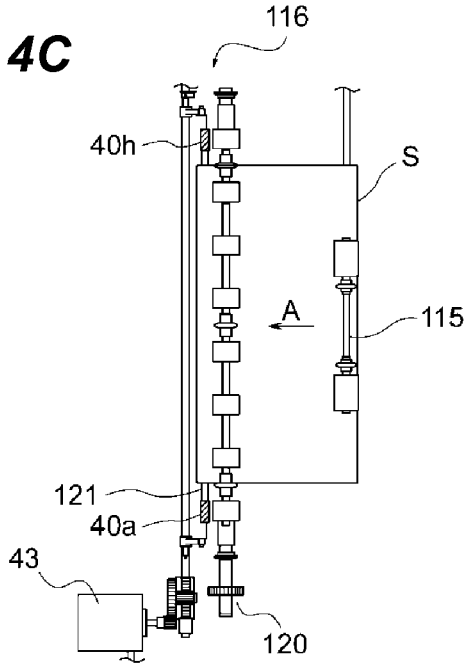

FIGS. 4A to 4C are plane views illustrating positional relation between the abutment pieces 40*a* to 40*h* of the shutter 121 and the sheet S. FIGS. 4A to 4C are views viewed from the upper side of the conveying path. FIGS. 5A to 5C are side views illustrating positional relation between the abutment pieces 40 of the shutter 121 and the sheet S. FIG. 5A corresponds to FIG. 4A, FIG. 5B corresponds to FIG. 4B, and FIG. 5C corresponds to FIG. 4C.

In the following, operation to correct skew feeding of the sheet S by the shutter 121 will be described with reference to FIGS. 4 and 5. As illustrated in FIG. 5A, the sheet S is conveyed by the pair of pre-registration rollers 115 and the top end of the sheet S is abutted to the abutment piece 40*g* of the shutter 121 in a state that the upper roller 20 and the lower roller 10 are separated. Skew feeding of the sheet S is corrected as the top end of the sheet S being aligned to the shutter 121 by rotating the pair of pre-registration rollers 115 until the top end of the sheet S in the sheet conveyance direction A is abutted to all of the abutment pieces 40. Here, when the pair of pre-registration rollers 115 is further rotated in a state that the top end of the sheet S in the sheet conveyance direction A is abutted to all of the abutment pieces 40 of the shutter 121, a loop is formed at the sheet S.

By releasing push-up of the upper roller 20 due to the separation lever 30 after the pair of pre-registration rollers 115 is rotated until the top end of the sheet S in the sheet conveyance direction A is abutted to all of the abutment pieces 40, the sheet S is nipped by the pair of registration rollers 120 (see FIGS. 4B and 5B). Subsequently, the shutter 121 is retracted from the conveying path, and then, the sheet S is conveyed by the pair of registration rollers 120 in a state that skew feeding is corrected (see FIGS. 4C and 5C).

FIG. 6 is a block diagram illustrating a connection state among the controller 50 as the controller and peripheral devices thereof. As illustrated in FIG. 6, the controller 50 is connected with an operation portion 200, the motor 61 of the vertical movement apparatus 60, the motor 43 of the horizontal movement apparatus 42, a feeding motor 54, the registration sensor 117 and the size detection portion 130. Further, the controller 50 is connected with a computer 201.

The controller 50 as the controller controls driving of the horizontal movement apparatus 42. The controller 50 performs following control based on information of a dimension in the sheet width direction M out of sizes of the sheets S detected by the size detection portion 130 and information of positions of the abutment pieces 40 of the shutter 121. The controller 50 calculates a widthwise movement amount of the abutment pieces 40 in the sheet width direction M so that a corner part of the top end of the sheet S is not to be abutted to any of the abutment pieces 40. Then, the controller 50 controls driving of the horizontal movement apparatus 42 and the horizontal movement apparatus 42 moves the shutter 121 in the sheet width direction M by the widthwise movement amount before the sheet S is abutted to the abutment pieces 40.

Figure 7:
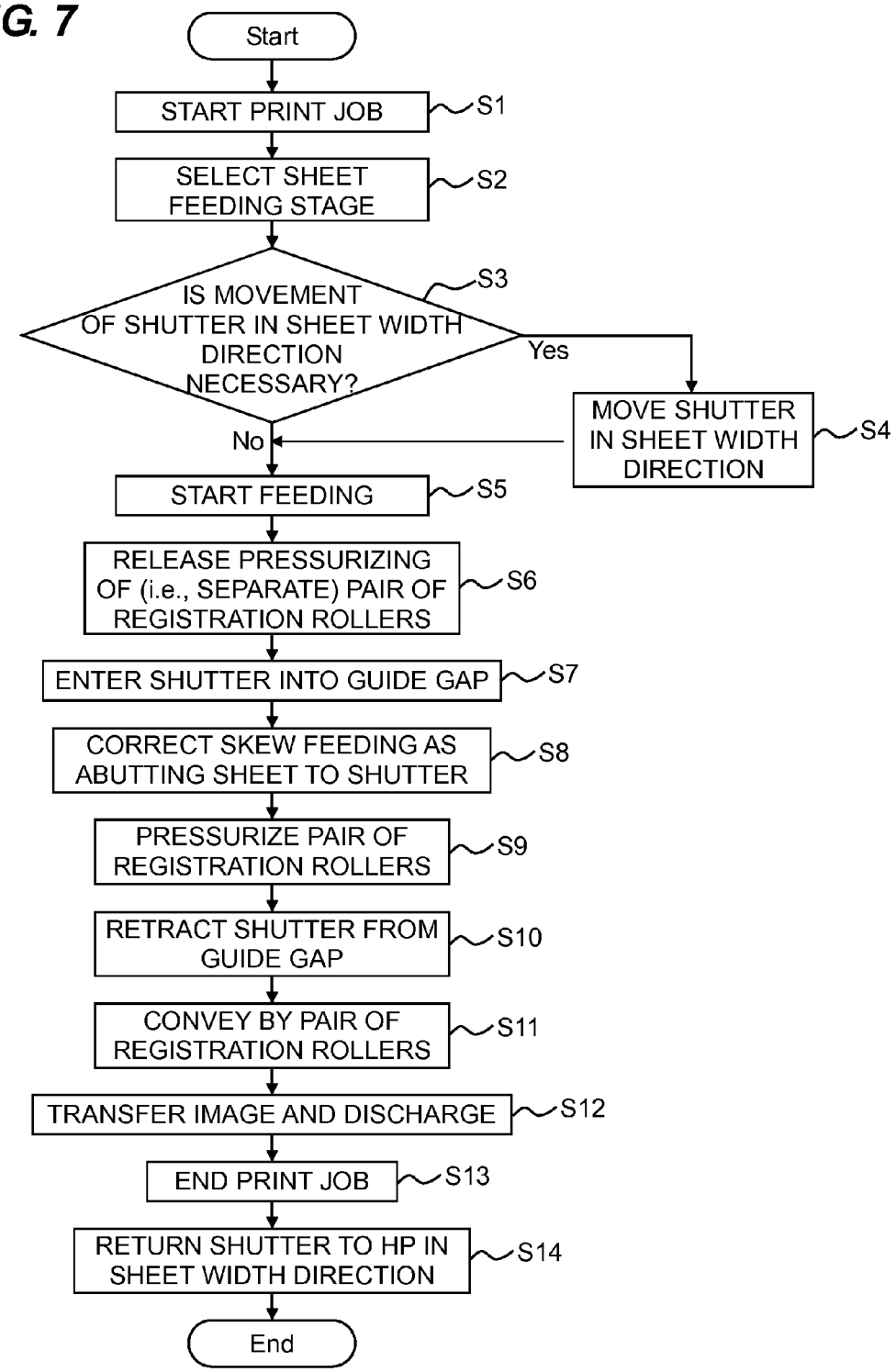
FIG. 7 is a flowchart showing a control process of the controller.

FIG. 7 is a flowchart showing a control process of the controller 50. As described in FIG. 7, the controller 50 performs a print job (step 1; hereinafter, "step" is described to be "S" as S1). Before performing a print job, job information is received from the operation portion 200 of the image forming apparatus 100 or the computer 201 connected to the image forming apparatus 100 directly or via a network.

Here, when a user selects the sheet cassette 111, 112 or the manual feeding portion 113 while selecting the number of print copies, the signal thereof is received by the controller 50 (S2). At that time, the size of the sheet S in the sheet width direction M is already acknowledged by the above-mentioned size detection portion 130. The controller 50 determines whether movement of the shutter 121 in the sheet width direction M is necessary corresponding to the width of the sheet S (S3). Only in a case that the result of determination in S3 is "YES" (i.e., being necessary), the controller 50 performs movement in the sheet width direction M by a specified amount (S4). Details of moving operation in the sheet width direction M and arrangement of the shutter 121 will be described below. FIG. 4A illustrates a state after the shutter 121 is moved in the sheet width direction M with the arrangement in which a corner part of the sheet S is not abutted to any of the abutment pieces 40.

In a case that the result of determination in S3 is "NO" (i.e., being unnecessary), the controller 50 starts feeding operation of the sheet S (S5). Subsequently, the sheet S is conveyed to the skew-feeding correcting apparatus 116. As illustrated in FIG. 5A, the controller 50 separates the pair of registration rollers 120 with the separation lever 30 (S6). When the sheet S is conveyed in the sheet conveyance direction A in a state of skew feeding as the back side of the apparatus body 100A being advanced, the controller 50 enters the abutment pieces 40 of the shutter 121 into a gap of the conveying guide 80 (S7). Then, the top end at the right side of the sheet conveyance direction A of the sheet S is abutted to the abutment piece 40*g* at the back side of the apparatus body 100A. At that time, since resting torque of the motor 61 (e.g., a stepping motor) is larger than abutting force due to stiffness of the sheet S, the shutter 121 remains stopped and traveling of the sheet S is blocked at the part abutted to the abutment piece 40*g*.

Meanwhile, since the sheet S is skew-fed at that time, the sheet S is not abutted yet to the abutment piece 40*b* at the front side of the apparatus body 100A in FIG. 4A. Then, with continuous conveying by the pair of pre-registration rollers 115, a loop is formed and the sheet S is also abutted to the abutment piece 40*b* at the front side of the apparatus body 100A where the sheet S has not been abutted, as illustrated in FIGS. 4B and 5B. In this manner, skew feeding of the sheet S is corrected (S8).

The controller 50 releases push-up of the upper roller 20 due to the separation lever 30 thereafter, so that the sheet S is nipped by the pair of registration rollers 120 (S9). As illustrated in FIGS. 4C and 5C, the controller 50 retracts the shutter 121 from the gap of the conveying guide 80 (S10). The controller 50 starts rotation of the pair of registration rollers 120, so that the sheet S is conveyed to the image transfer portion at the downstream side in the sheet conveyance direction A in a state that skew feeding is corrected (S11). The sheet S to which an image is transferred at the image transfer portion is discharged to the outside of the apparatus body 100A from the discharge portion 119 (S12). Then, the controller 50 ends a series of print jobs (S13). The controller 50 returns the shutter 121 to a home position (HP) before being moved in the sheet width direction M (S14).

Figure 8:
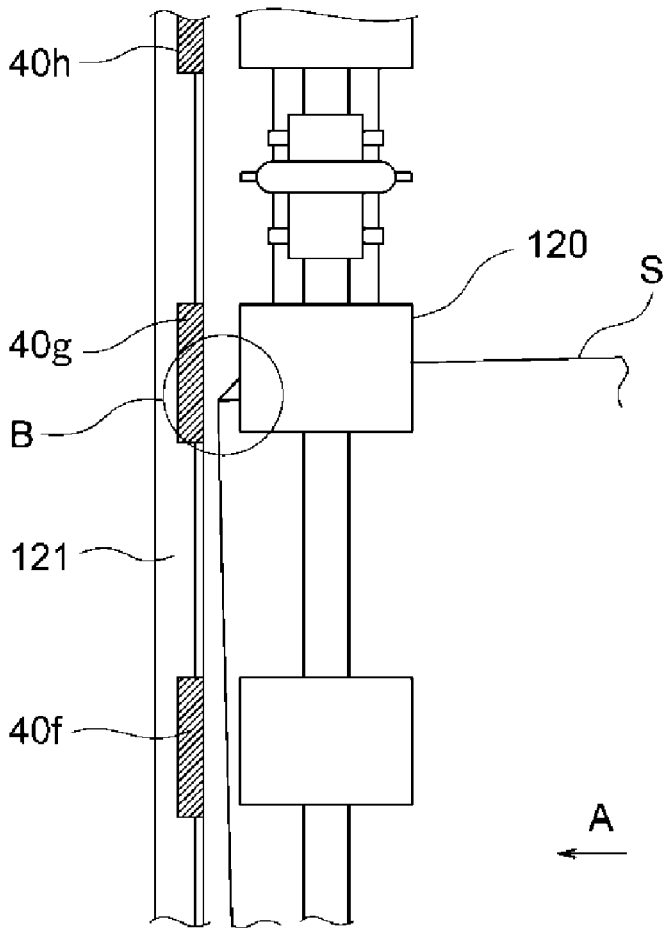
FIG. 8 is a plane view illustrating a hypothetical state in which a corner part of a sheet is abutted to an abutment piece.

FIG. 8 is a plane view illustrating a hypothetical state in which a corner part of the sheet S is abutted to the abutment piece 40*g*. Next, description is performed on a case that a corner part of the top end of the sheet S is abutted to the abutment piece 40*g* without moving of the shutter 121 in the sheet width direction M with reference to FIG. 8. The sheets S may approach the shutter 121 in various states. There may be a case that a corner part of the top end of the sheet S indicated by an area B is curled owing to surroundings or with the sheet S for duplex printing. In general, a corner part of the sheet S has less stiffness and is more likely to be buckled. In addition, when the corner part of the sheet S is curled, the possibility that the sheet S is buckled is increased. Consequently, there may be a case that corner creasing and jamming of the sheet S occur.

On the contrary, the skew-feeding correcting apparatus 116 is arranged in the sheet width direction M so that a corner part of the top end of the sheet S is not abutted to the abutment piece 40*g*. Therefore, a part of the sheet S being abutted to the abutment piece 40*g* is to be at the center side from the corner part of the top end of the sheet S. Then, as illustrated in FIG. 3, the sheet S is restricted by the upper guide 81 and the lower guide 82 having the guide gap being 2 mm between the adjacent abutment pieces 40*a* to 40*g*. Therefore, according to the skew-feeding correcting apparatus 116, there is not a possibility of occurrence of corner creasing and jamming of the sheet S even when the sheet S has a curled corner part as illustrated in FIG. 8.

Figure 10B:
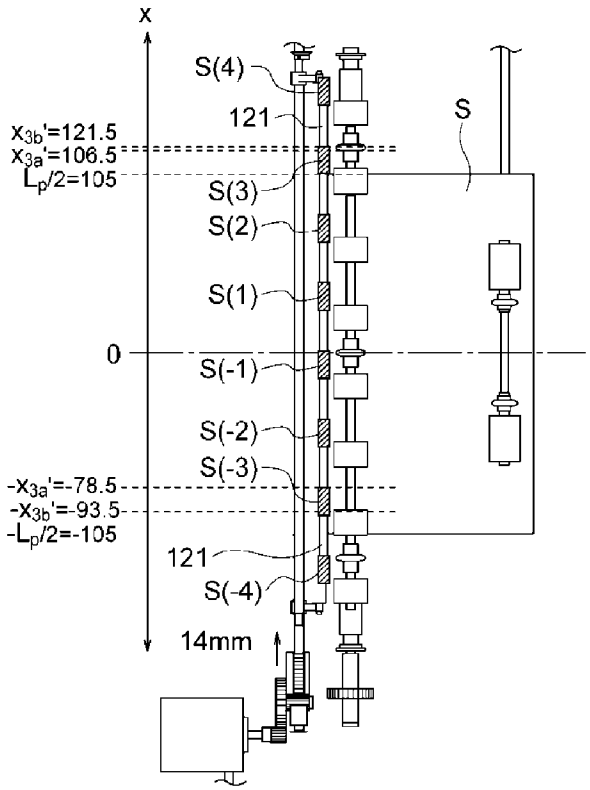
FIGS. 10A and 10B are plane views illustrating positional relation between the shutter and the sheet.
Figure 10A:
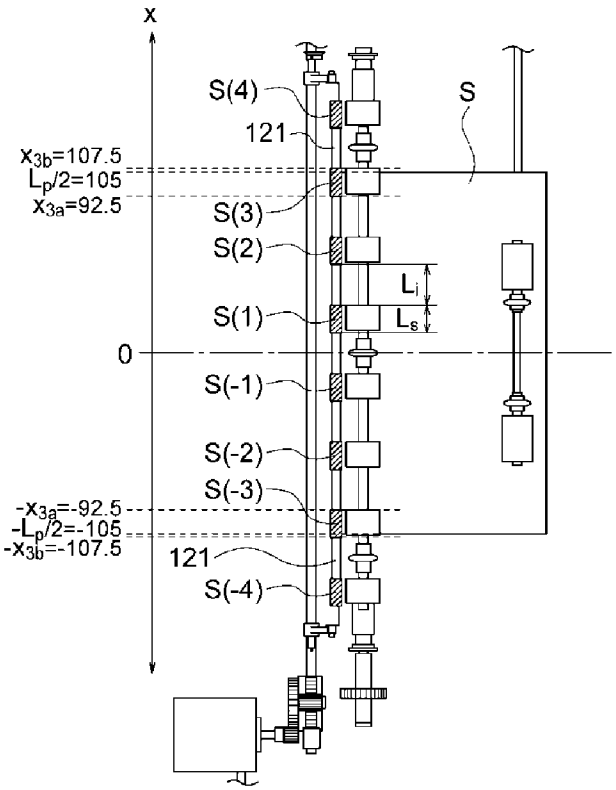

FIGS. 10A and 10B are plane views illustrating positional relation between the shutter 121 and the sheet S. FIG. 10A illustrates a state before the shutter 121 is moved in the sheet width direction M and corresponds to a plane view illustrating a state that a corner part of the sheet S is abutted to the abutment piece 40 of the shutter 121. FIG. 10B illustrates a state after the shutter 121 is moved in the sheet width direction M and corresponds to a plane view illustrating a state that the corner part of the sheet S is not abutted to the abutment piece 40 of the shutter 121. Next, description is performed on arrangement in the sheet width direction M and a movement amount in the sheet width direction M of the abutment pieces 40 with reference to FIGS. 10A and 10B.

As illustrated in FIGS. 10A and 10B, in the shutter 121, the width of the abutment piece is denoted by $L_s$ and the interval between the adjacent abutment pieces is denoted by $L_i$. The center against the image forming portion is set to be the zero point and the direction toward the back side of the apparatus body 100A is "+x" direction. Here, as an example, an even number of the abutment pieces 40 are arranged having the same $L_s$ and $L_i$. Further, the abutment pieces 40 are arranged being symmetrically shaped against "x=0". Here, the abutment pieces 40*a* to 40*h* are indicated as S(−4) to S(4). End positions of the nth abutment piece 40 from the center are expressed as "$x_{na}=L_i/2+(n-1)(L_s+L_i)$" and "$x_{nb}=x_{na}+L_s$" respectively from the center side. Incidentally, a wide variety of sizes of the sheets S are used for a copying machine. Here, necessity of the movement of the shutter 121 in the sheet width direction M is determined owing to whether end positions $L_p/2$ of the sheet S of each size is in a range between $x_{na}$ and $x_{nb}$ as $L_p$ denoting the sheet width. That is, in a case of "$x_{na}<L_p/2<x_{nb}$", the shutter 121 is required to be moved in the sheet width direction M so that sheet corner parts are prevented from being abutted to any of abutment pieces 40. Similarly, "$-x_{nb}<-L_p/2-x_{na}$" is obtained in a case of "x<0".

To prevent abutting of both sheet corner parts from being abutted to any of the abutment pieces 40, the larger value between "$x_{nb}-Lp/_2$" and "$Lp/_2-x_{na}$" is the movement amount in the sheet width direction M required at minimum. Abutting to the abutment pieces 40 is prevented with movement simply by the abutment piece width $L_s$ at maximum. In other words, the minimum widthwise movement amount by which the shutter 121 is moved in the sheet width direction M can be described as follows. That is, the minimum widthwise movement amount is an absolute value amount of difference between a position having a larger distance to a corner part of the top end of the sheet S out of the positions at both ends of the abutment pieces 40 in the sheet width direction M and a position of the corner part of the top end of the sheet S.

Further, to prevent the sheet S from being abutted to the adjacent abutment piece 40 after the shutter 121 is moved in the sheet width direction M, the dimension of the abutment pieces 40 in the sheet width direction M is desirably to be small so as not to be abutted to the extent possible with movement by $L_s$. That is, it is desirable to satisfy "$L_s<L_i$". In other words, the abutment piece width $L_s$ of the abutment pieces 40 is desirably to be smaller than the interval $L_i$ between the adjacent abutment pieces 40. In addition, material quality and cost can be reduced with the abutment pieces 40 each having the smaller dimension in the sheet width direction.

FIG. 11A is a table indicating relation between an abutment piece number and abutment piece end positions. Here, substance described above with reference to FIGS. 10A and 10B is described with specific numerical values with reference to FIG. 11A. In the shutter 121 of FIG. 10A, "$L_s$=15 mm", "$L_i$=25 mm (being larger than $L_s$)", and the abutment piece number is to be 8 as being arranged as S(−4) to S(4).

FIG. 11B is a table indicating necessity determination of movement and a movement amount in the sheet width direction M of the shutter 121 for each sheet width of sizes of popular sheets S listed therein. As illustrated in FIG. 11B, in a case of A4R (i.e., longitudinal feeding of A4 sheets) for example, corner parts of the sheet S are to be abutted to S(3) and S(−3) at the third abutment piece positions from the center. Here, the corner parts of the sheets S can be prevented from being abutted to S(3) and S(−3) by moving the shutter 121 in the sheet width direction M by at least 12.5 mm ($L_p/2-x_{3a}$=105−92.5). Either of "+x direction" and "−x direction" may be adopted as the movement direction of the shutter 121. For example, in a case of movement in "+x direction" by 12.5 mm, the top end of the sheet S is to be abutted to five pieces of the abutment pieces from S(−3) to S(2). In a practical sense, it often happens that variation of the order of 1 to 1.5 mm appears as end position deviation of the sheet S being so-called lateral registration deviation caused by conveyance variation from when the sheet S is fed to when the sheet reaches the shutter 121. Therefore, it is also possible that the movement amount in the sheet width direction M is to be 14 mm which is acquired by adding the lateral registration deviation amount to 12.5 mm described above. FIG. 10B illustrates the arrangement of the above case. Here, the upper limit value of the movement in the sheet width direction M is to be 27.5 mm ($=-L_p/2-(-x_{3b})+L_i=-105-(-107.5)+25$) as satisfying conditions to prevent re-abutting to S(−4).

In a case of the shutter 121 having the present structure, the required movement amount in the sheet width direction M depends on $L_s$. That is, the smaller $L_s$ is, the smaller the movement in the sheet width direction M may be. However, in a case that $L_s$ is small, there may be a possibility that the top end of the sheet S receives damage such as an abutment mark owing to concentration of abutment force when the top end of the sheet S is abutted to the shutter 121. Therefore, it is desirable that $L_s$ is to be set based on the possible amount of movement in the sheet width direction M and the top end damage.

In the description with FIGS. 11A and 11B, typical examples of popular sizes of the sheets S are listed and the required movement amounts in the sheet width direction M are calculated therefor. However, the present invention is not limited to the above. Further, the calculation method can be applied similarly to the sheets S other than regular-sized sheets such as irregular paper. Further, it is also possible that the table as illustrated in FIG. 11B in which sheet types and movement amounts of the abutment portions are mutually associated is stored in the controller 50 as previously calculating the movement amounts of the abutment portions from each sheet type (i.e., each sheet size) and abutment piece width. In this case, the controller 50 obtains the movement amount of the abutment portions from the table and controls driving of the movement portion so that the abutment portions are moved by the movement amount. Here, if the movement amount of the shutter 121 is determined as adding an assumed conveyance variation amount to the minimum movement amount with which sheet corner parts are to be prevented from being abutted to the shutter 121 in consideration of positional deviation of the sheet S in the width direction caused by conveyance variation from when the sheet S is fed to when the sheet reaches the shutter as described above, the effects of the invention will not be disturbed by the positional deviation in the width direction even when the positional deviation occurs in the sheet width direction M perpendicular to the sheet conveyance direction A.

Figure 12:
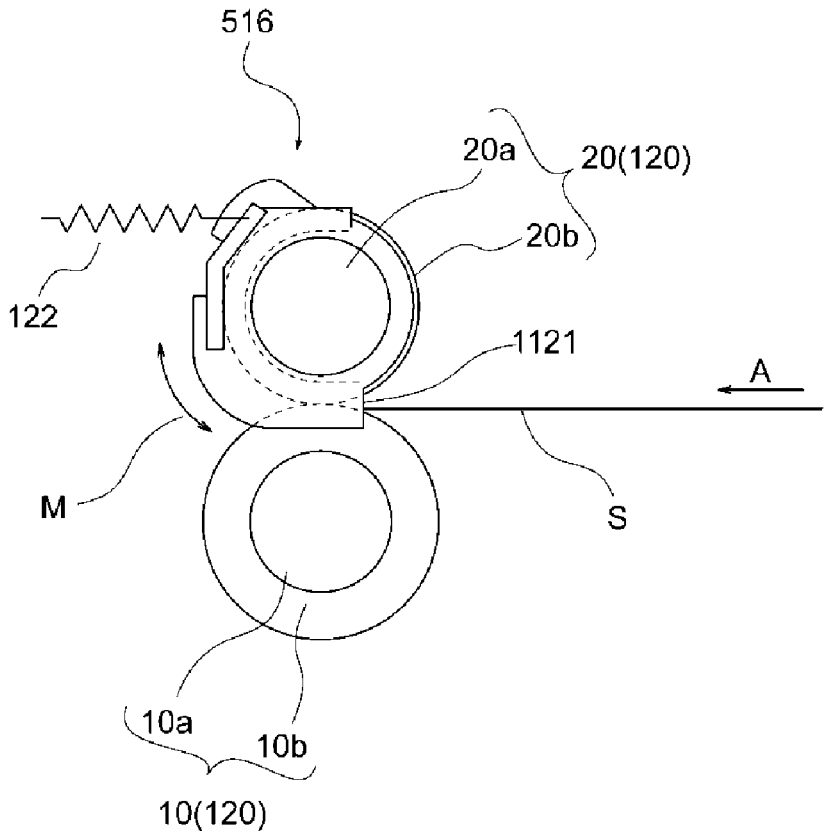
FIG. 12 is an enlarged partial side view illustrating a structure of a skew-feeding correcting apparatus according to a modification of the first embodiment.

FIG. 12 is an enlarged partial side view illustrating a structure of a skew-feeding correcting apparatus 516 according to a modification of the first embodiment. A structure as illustrated in FIG. 12 may be adopted as a shutter having abutment pieces as the abutment portions. As illustrated in FIG. 12, a shutter 1121 is rotatably supported on a shaft of the upper roller 20 and the shutter 1121 is moved owing to stiffness of the sheet S. Here, returning operation after passing of the sheet S is performed by a spring member 122. Alternatively, a shutter having abutment pieces as the abutment portions may have a structure (not illustrated) in which the shutter 1121 is retracted and entered by a shutter driving apparatus.

<Second Embodiment>

Figure 13:
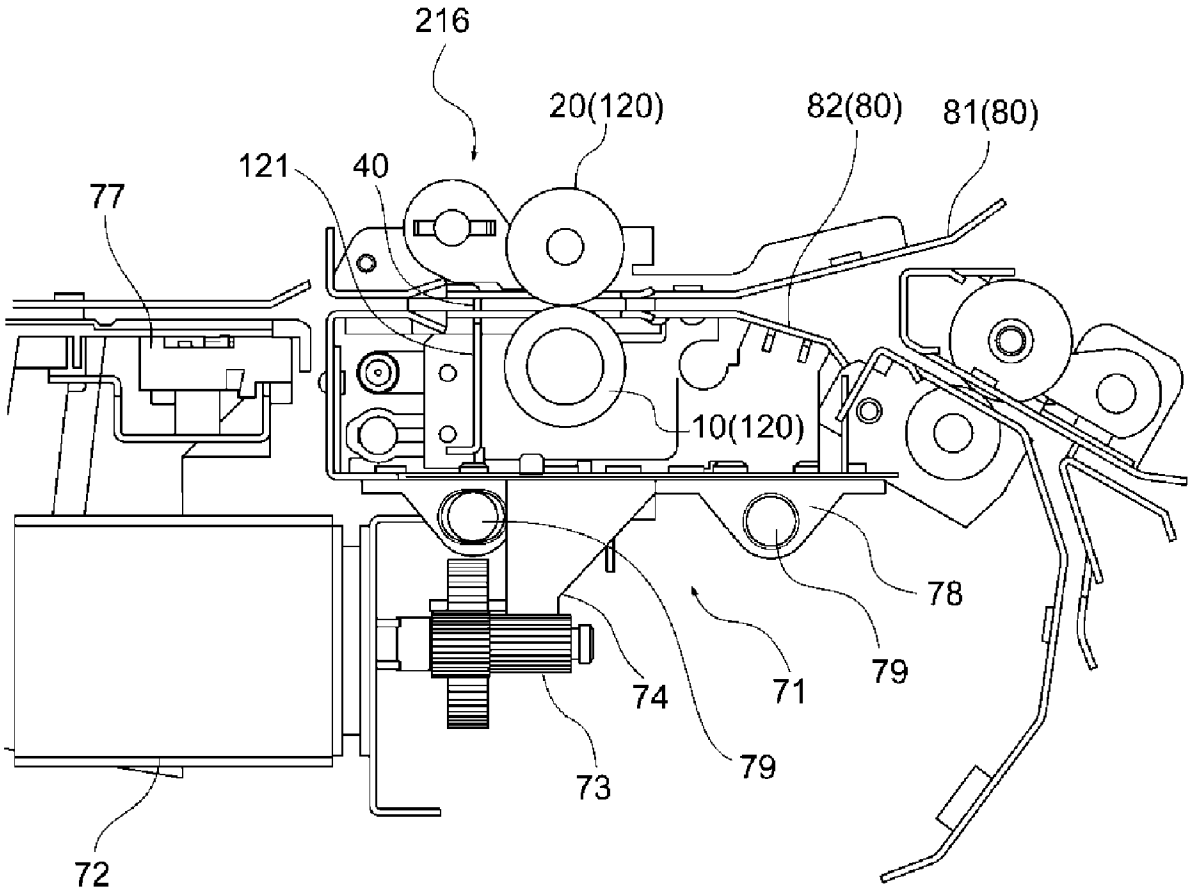
FIG. 13 is an enlarged partial sectional view illustrating a structure of an image forming apparatus including a skew-feeding correcting apparatus according to a second embodiment.

FIG. 13 is an enlarged partial sectional view illustrating a structure of an image forming apparatus including a skew-feeding correcting apparatus 216 according to a second embodiment. Description on the same structure and effect in the structure of the skew-feeding correcting apparatus 216 of the second embodiment as those of the skew-feeding correcting apparatus 116 of the first embodiment will not be repeated appropriately as utilizing the same numeric symbols. Since the second embodiment can be also applied to the similar image forming apparatus of the first embodiment, description on the image forming apparatus will not be repeated. The skew-feeding correcting apparatus 216 of the second embodiment differs from the skew-feeding correcting apparatus 116 of the first embodiment as follows.

As illustrated in FIG. 13, the skew-feeding correcting apparatus 216 includes a shift unit 71. The shift unit 71 includes a support member 78 which collectively supports the shutter 121, the pair of registration rollers 120, and the conveying guide 80. Further, the shift unit 71 includes a pinion gear 73 which moves the support member 78 in the sheet width direction M and a motor 72 which rotates the pinion gear 73. The support member 78 is provided with a rack 74 to be engaged with the pinion gear 73. The support member 78 is supported movably in the sheet width direction M owing to two guide shafts 79 extended in the sheet width direction M. According to the above structure, the shift unit 71 is capable of integrally moving the shutter 121, the pair of registration rollers 120, and the conveying guide 80 in the sheet width direction M. Here, the conveying guide 80 includes the upper guide 81 and the lower guide 82.

Further, the skew-feeding correcting apparatus 216 includes a line sensor 77 as an end position detection portion. The line sensor 77 is placed at the downstream side from the shutter 121 in the sheet conveyance direction A and detects a positional deviation amount as the end of the sheet S in the sheet width direction M. Further, the skew-feeding correcting apparatus 216 includes the controller 50. The controller 50 moves the pair of registration rollers 120 in the sheet width direction M based on a detection result of the line sensor 77, so that positional deviation of the end of the sheet S is corrected. Other features such as the basic structure for skew feeding correction, necessity determination of movement of the shutter 121 in the sheet width direction M, and the movement amount of the shutter 121 in the sheet width direction M to prevent sheet corner parts from being abutted to the shutter 121 are the same as those of the first embodiment.

When the controller 50 drives the motor 72, the pinion gear 73 is rotated and the rack 74 is moved in the sheet width direction M by a specified amount. Thus, the shutter 121, the pair of registration rollers 120 and the conveying guide 80 are integrally moved in the sheet width direction M without varying relative positions thereof. In a case that a structure in which the shutter 121, the pair of registration rollers 120 and the conveying guide 80 can be moved separately in the sheet width direction M, flexibility of arrangement of the shutter 121 and the conveying guide 80 is impaired. In this case, there arises an issue such that the abutment pieces 40 of the shutter 121 cannot be moved in the sheet width direction M unless dimensions in the sheet width direction M of the cutout 81*a* and the cutout 82*a* of the conveying guide 80 are enlarged. In the second embodiment, since the shutter, the registration rollers and the conveying guide are structured to be integrally moved, flexibility of arrangement is improved.

In addition, it is also possible to have a structure in which the upper roller 20 and the lower roller 10 of the pair of registration rollers 120 and the abutment pieces 40 of the shutter 121 are mutually overlapped. That is, it is also possible to have a structure in which each abutment piece 40 of the shutter 121 is arranged between the pairs of rollers (20, 10) formed of the upper roller 20 and the lower roller 10, respectively as being viewed from the sheet conveyance direction A. In other words, it is also possible to have a structure in which the separated pairs of rollers (20, 10) and the abutment pieces 40 are arranged alternately as each abutment piece 40 is placed next to each pair of rollers (20, 10) in the sheet width direction M. According to the structure, the abutment pieces 40 of the shutter 121 are not required to be arranged at the outer side from the outer diameter of the pair of the registration rollers 120 in the sheet conveying direction A. Accordingly, the abutment pieces 40 can be arranged as being closer to the metal shaft 20*a* and the metal shaft 10*a*. As a result, bending phenomenon of the sheets S between the separated pairs of rollers (20, 10) and the abutment pieces 40 in the sheet conveyance direction can be further reduced.

In addition to the skew feeding correction by the shutter 121, the skew-feeding correcting apparatus 216 illustrated in FIG. 13 corrects image position deviation in the sheet width direction M perpendicular to the sheet conveyance direction A (i.e., the lateral registration correction). In the following, general operation of the skew-feeding correcting apparatus 216 will be described. First, at the time of starting printing, the shutter 121 is moved in the sheet width direction M by the shift unit 71 corresponding to a size of the sheet S, as being similar to the first embodiment. That is, the position of the shutter 121 in the sheet width direction is adjusted so that a sheet corner part is not abutted to the shutter 121 before the sheet top end abuts the shutter 121. Then, skew feeding of the sheet is corrected as the sheet being abutted to the shutter 121. The sheet of which skew feeding is corrected is nipped by the pair of registration rollers 120. After the shutter 121 is retracted from the conveying path, the sheet is conveyed by the pair of registration rollers 120.

During sheet conveyance by the pair of registration rollers 120, the line sensor (e.g., a CIS) 77 placed at the downstream side in the sheet conveyance direction A detects a lateral end position of the sheet S. The controller 50 derives difference against the image end position due to the image forming portion 51 as the lateral registration correction amount. The lateral registration correction can be performed in high accuracy as the pair of registration rollers 120 being moved in the sheet width direction M by the lateral registration correction amount by moving the support member 78 in a state that the sheet S is nipped by the pair of registration rollers 120. Here, the lateral registration correction denotes sheet position correction in the sheet width direction M to transfer the image to a desired position of the sheet at the transfer portion.

The above description is performed on the structure in which the shutter 121 is placed at the downstream side from the pair of registration rollers 120 and the both are moved integrally in the sheet width direction M. However, not being limited to the above, the present invention may be applied to a structure in which the shutter 121 is placed at the upstream side from the pair of registration rollers 120 as illustrated in FIG. 12 and the both are moved integrally in the sheet width direction M.

<Third Embodiment>

Figure 14:
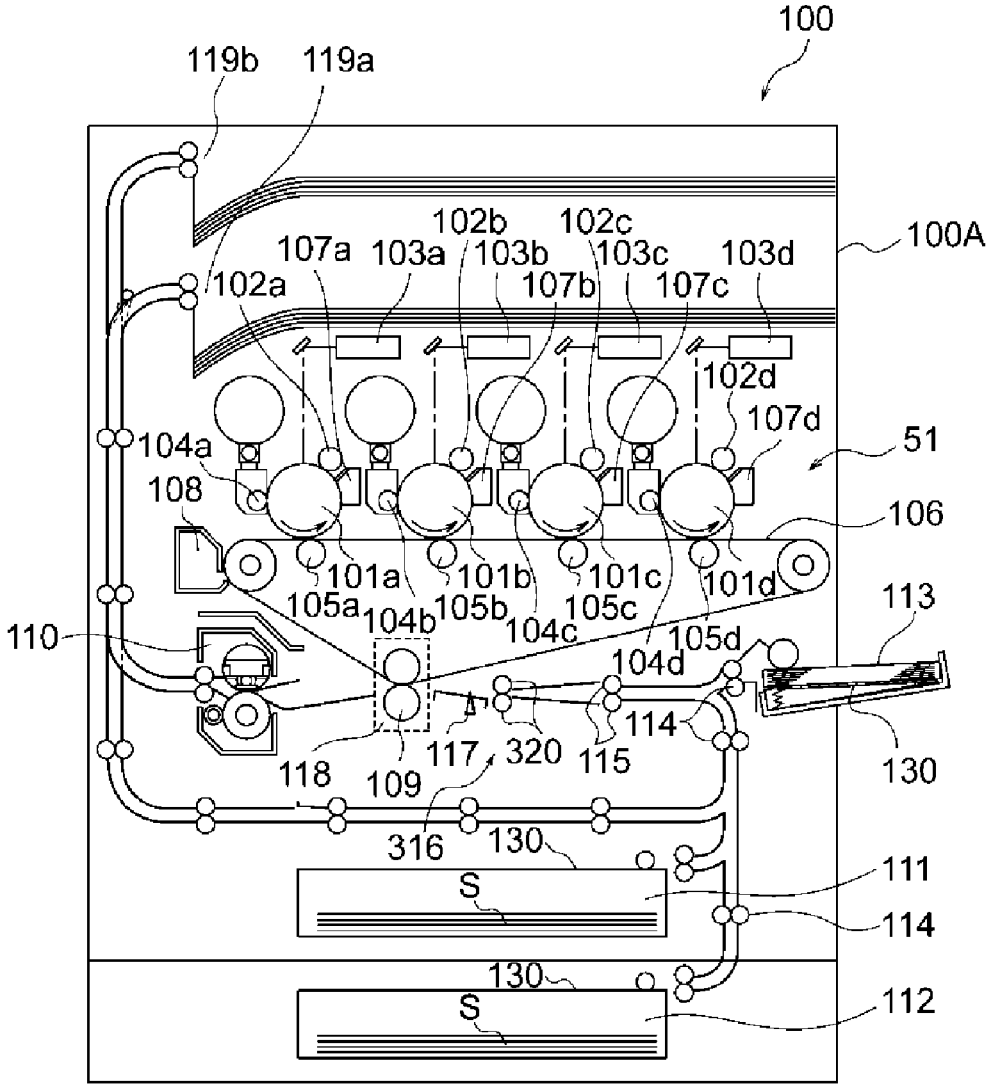
FIG. 14 is a sectional view illustrating a structure of an image forming apparatus including a skew-feeding correcting apparatus according to a third embodiment.

FIG. 14 is a sectional view illustrating a structure of an image forming apparatus including a skew-feeding correcting apparatus 316 according to a third embodiment. Description on the same structure and effect in the structure of the skew-feeding correcting apparatus 316 of the third embodiment as those of the skew-feeding correcting apparatuses 116, 216 of the first and second embodiments will not be repeated appropriately as utilizing the same numeric symbols. Since the third embodiment can be also applied to the similar image forming apparatus of the first and second embodiments, description on the image forming apparatus will not be repeated. The skew-feeding correcting apparatus 316 of the third embodiment differs from the skew-feeding correcting apparatuses 116, 216 in that a pair of registration rollers 320 is moved in the sheet width direction M. Here, the basic structure for skew feeding correction, necessity determination of movement in the sheet width direction M, and the movement amount in the sheet width direction M are the same as those of the first embodiment. As illustrated in FIG. 14, the skew-feeding correcting apparatus 316 is not provided with the shutter 121. Here, separated pairs of rollers 340 of the pair of the registration rollers 120 exert the above-mentioned function of the abutment pieces 40 of the shutter 121.

That is, the top end of the sheet S in the sheet conveyance direction A is abutted to a nip portion of the pair of registration rollers 320 of which rotation is stopped. The pair of registration rollers 320 includes the separated pairs of rollers 340 (see FIG. 15) being the plurality of abutment portions. The plurality of separated pairs of rollers 340 is set to have a roller width so that a corner part of the top end of the sheet S in the sheet conveyance direction A is not abutted to any of the separated pairs of rollers 340.

Figure 15:
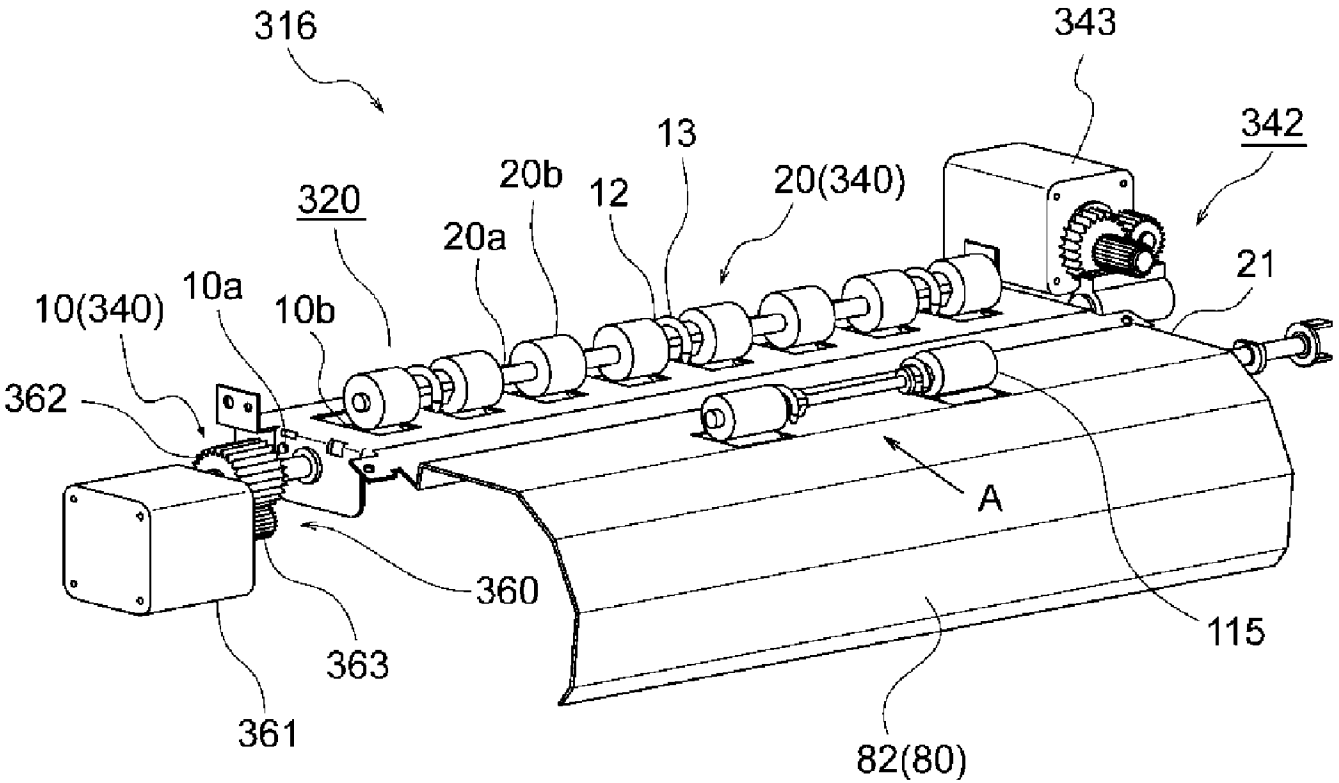
FIG. 15 is perspective view illustrating a structure of the skew-feeding correcting apparatus.

FIG. 15 is a perspective view illustrating a structure of the skew-feeding correcting apparatus 316. In FIG. 15, the lower guide 82 of the conveying guide 80 is illustrated while the upper guide 81 of the conveying guide 80 is not illustrated. As illustrated in FIG. 15, the skew-feeding correcting apparatus 316 includes the plurality of separated pairs of rollers 340. The top end of the sheet S is abutted to the nip portions of the separated pairs of rollers 340. The separated pairs of rollers 340 include the upper roller 20 and the lower roller 10. The structure of the upper roller 20 is illustrated in FIG. 15. The upper roller 20 includes the metal shaft 20*a* and the plurality of rollers 20*b* fitted to the metal shaft 20*a*. The lower roller 10 includes the metal shaft 10*a* and the plurality of rubber rollers 10*b* fitted to the metal shaft 10*a*. Further, a horizontal movement apparatus 342 being the movement portion moves the plurality of separated pairs of rollers 340 in the sheet width direction M. A driving apparatus 360 rotates a lower roller 10. Accordingly, the upper roller 20 is driven as well. Here, the horizontal movement apparatus 342 is driven with driving force of a motor 343. The driving apparatus 360 is driven with driving force of a motor 361.

The pair of registration rollers 320 to which the top end of the sheet S in the sheet conveyance direction A is abutted at the nip portion of the pair of registration rollers 320 when the skew-feeding correcting apparatus 316 corrects skew feeding of the sheet S include the plurality of separated pairs of rollers 340. Roller width of the plurality of separated pairs of rollers 340 is set so that a corner part of the top end of the sheet S in the sheet conveyance direction A is prevented from being abutted to any of the separated pairs of rollers 340. Further, the plurality of separated pairs of rollers 340 is capable of being moved in the sheet width direction M by the horizontal movement apparatus 342.

Figure 16A:
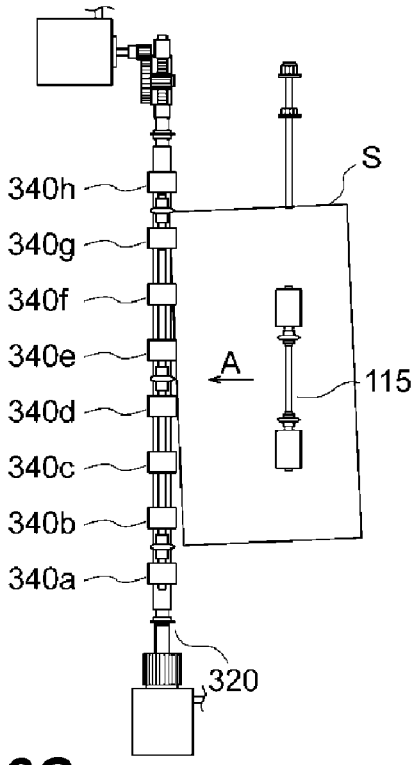
FIGS. 16A to 16C are plane views illustrating positional relation between separated pairs of rollers and a sheet.
Figure 16B:
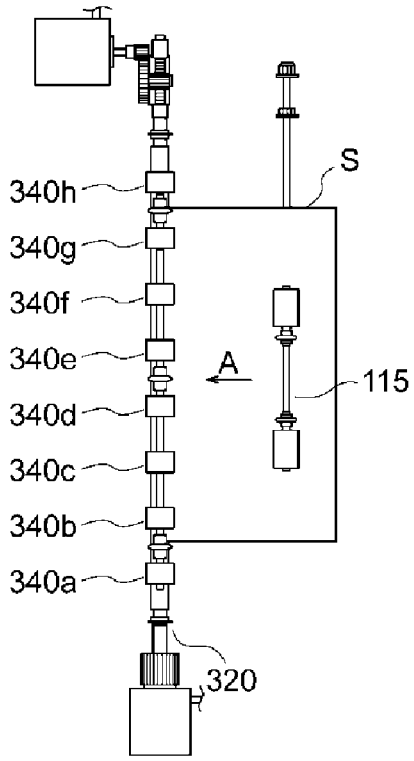
Figure 16C:
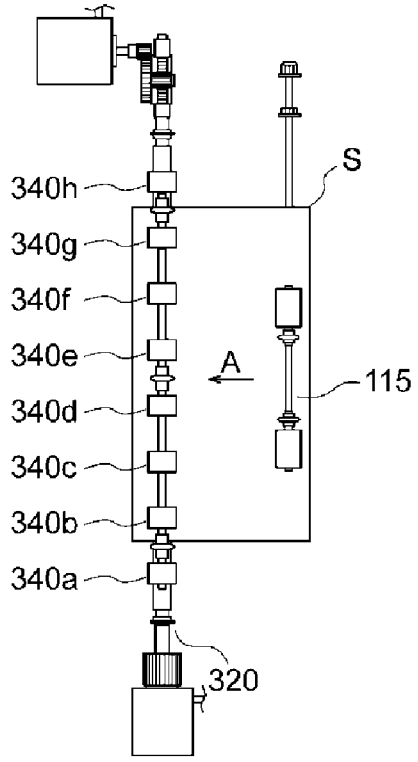
Figure 17A:
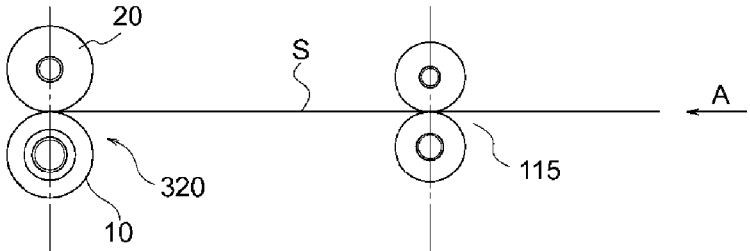
FIGS. 17A to 17C are side views illustrating positional relation between the separated pairs of rollers and the sheet.
Figure 17B:
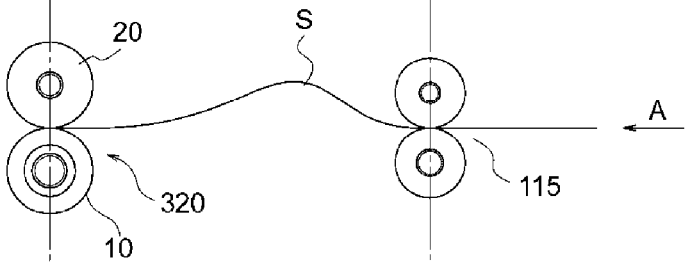
Figure 17C:
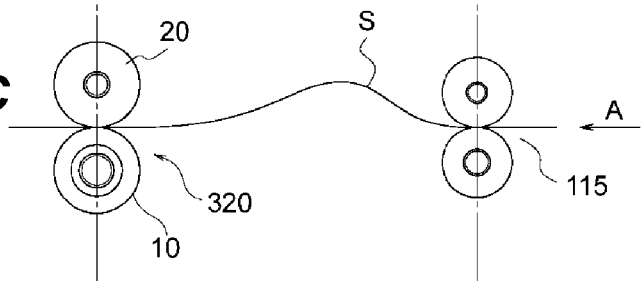

FIGS. 16A to 16C are plane views illustrating positional relation between the separated pairs of rollers 340 (i.e., 340*a* to 340*h*) and the sheet S. FIGS. 17A to 17C are side views illustrating positional relation between the separated pairs of rollers 340 and the sheet S. FIG. 16A and FIG. 17A are associated, FIG. 16B and FIG. 17B are associated, and FIG. 16C and FIG. 17C are associated. In the following, operation to correct skew feeding of the sheet S by the separated pairs of rollers 340 will be described with reference to FIGS. 16A to 16C and 17A to 17C. As illustrated in FIGS. 16A and 17A, the nip portion is formed as a result of contacting between the upper roller 20 and the lower roller 10. The sheet S is conveyed by the pair of pre-registration rollers 115 and a corner part of the sheet S is abutted to the nip portion of the registration rollers 320. As illustrated in FIGS. 16B and 17B, the top end of the sheet S in the sheet conveyance direction A is to be in a state of being entirely abutted to the pair of registration rollers 320 owing to rotation of the pair of registration rollers 320 in a state that the corner part of the sheet S is abutted to the nip portion. Then, owing to conveyance of the rear end of the sheet S in the sheet conveyance direction A, skew feeding is to be corrected while a loop is to be formed at the sheet S. Consequently, as illustrated in FIGS. 16C and 17C, the sheet S is conveyed in a state that skew feeding is corrected with rotation of the pair of registration rollers 320.

Figure 18:
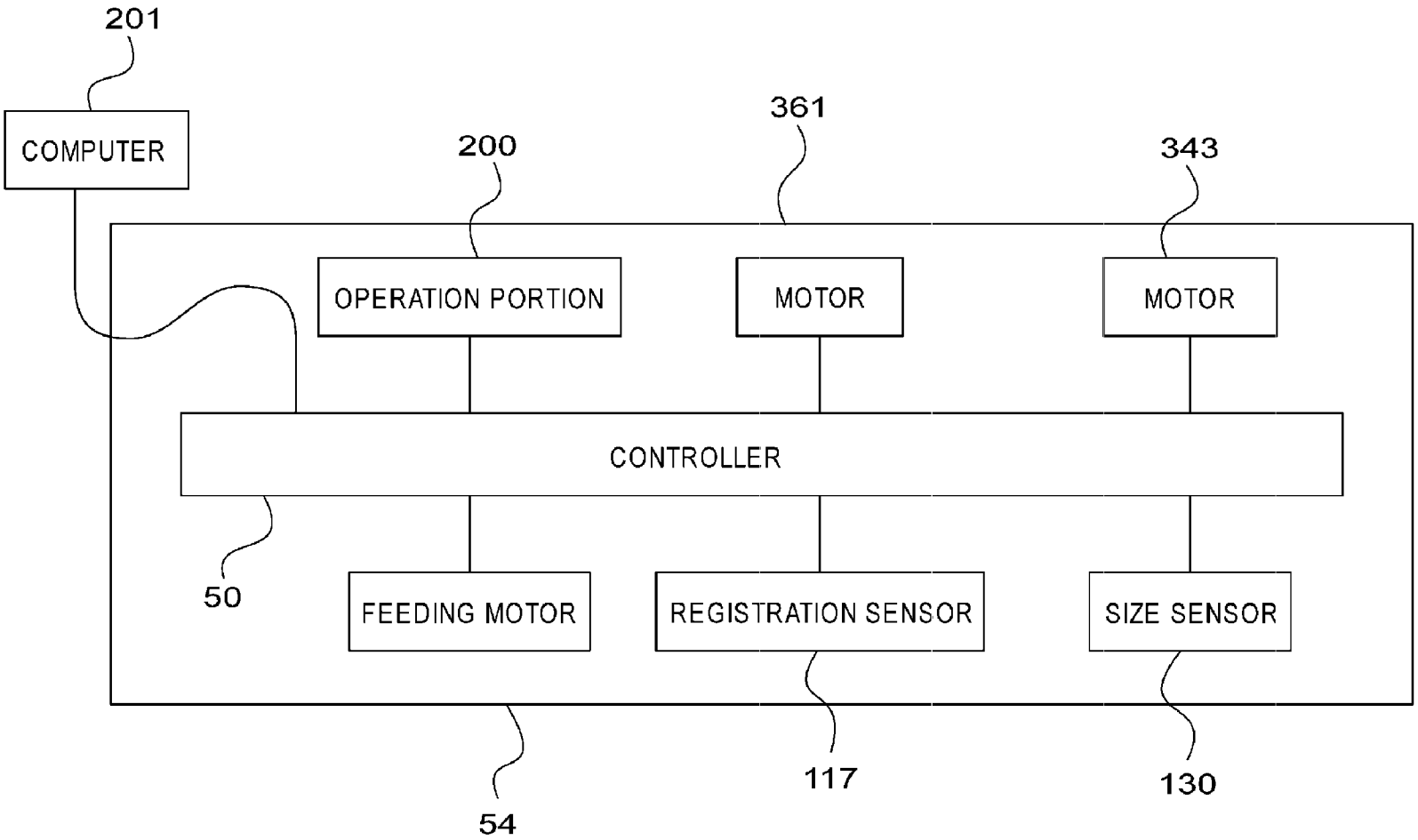
FIG. 18 is a block diagram illustrating a connection state among a controller and peripheral devices thereof.

FIG. 18 is a block diagram illustrating a connection state among the controller 50 and peripheral devices thereof. As illustrated in FIG. 18, the controller 50 is connected with the operation portion 200, the motor 361 of the driving apparatus 360, the motor 343 of the horizontal movement apparatus 342, the feeding motor 54, the registration sensor 117, and the size detection portion 130. Further, the controller 50 is connected with the computer 201.

The controller 50 as the controller controls driving of the horizontal movement apparatus 342. The controller 50 performs following control based on information of a dimension in the sheet width direction M out of sizes of the sheets S detected by the size detection portion 130 and information of positions of the separated pairs of rollers 340 of the pair of registration rollers 320. The controller 50 calculates a widthwise movement amount of the pair of registration rollers 320 in the sheet width direction M so that a front side corner part of the sheet S is not to be abutted to any of the separated pairs of rollers 340. Then, the controller 50 drives the horizontal movement apparatus 342 to move the pair of registration rollers 320 in the sheet width direction M by the widthwise movement amount before the sheet S is abutted to the pair of registration rollers 320.

Figure 19:
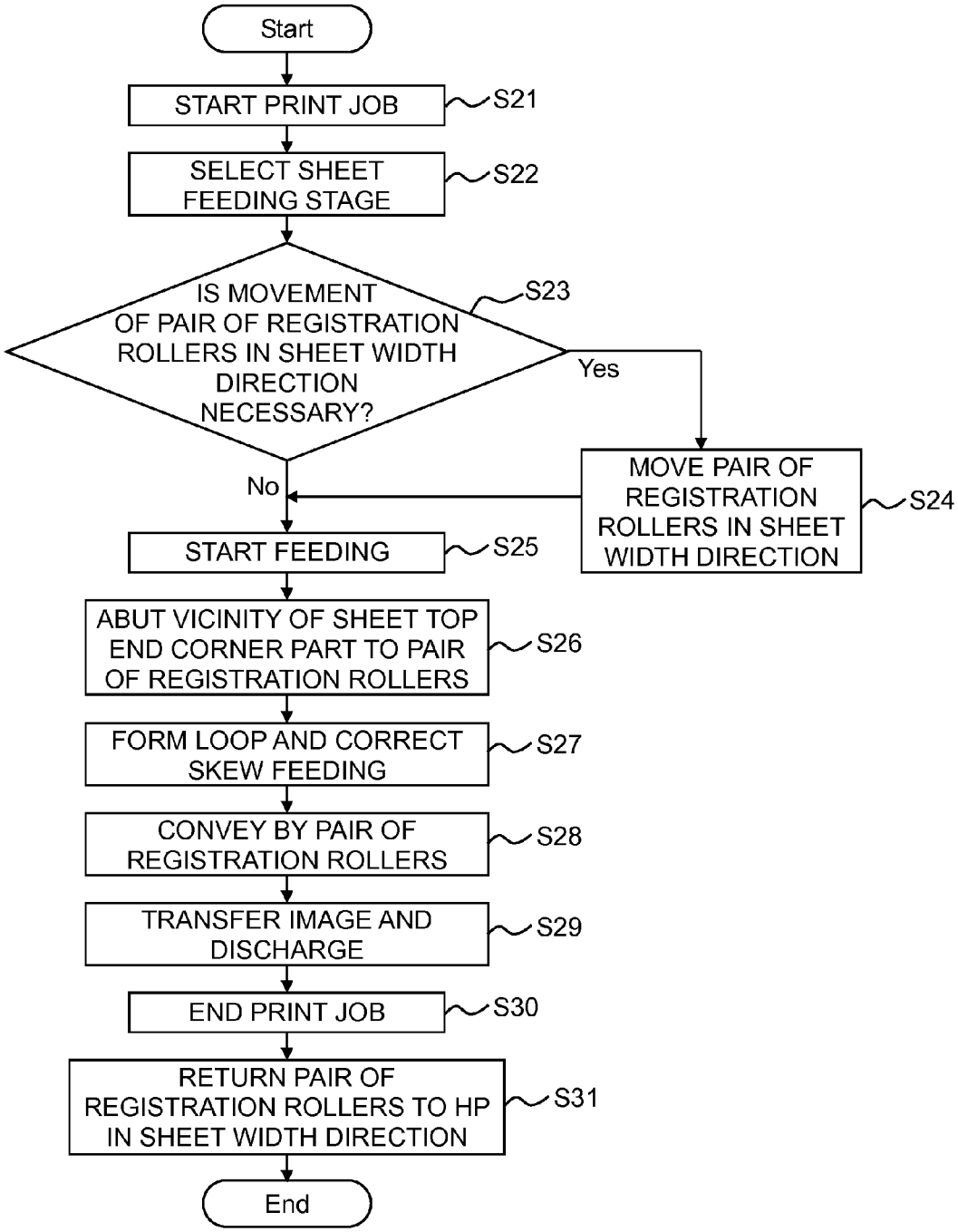
FIG. 19 is a flowchart showing a control process of the controller.

FIG. 19 is a flowchart showing a control process of the controller 50. As described in FIG. 19, the controller 50 performs a print job (S21). Before performing a print job, job information is received from the operation portion 200 of the image forming apparatus 100 or the computer 201 connected to the image forming apparatus 100 directly or via a network.

Here, when a user selects the sheet cassette 111, 112 or the manual feeding portion 113 while selecting the number of print copies, the signal thereof is received by the controller 50 (S22). At that time, the size of the sheet S in the sheet width direction M is already acknowledged by the above-mentioned size detection portion 130. The controller 50 determines whether movement of the pair of registration rollers 320 in the sheet width direction M (called also the thrust direction) is required (S23). Only in a case that the result of determination in S23 is "YES" (i.e., being necessary), the controller 50 performs movement in the sheet width direction M by a specified amount (S24). Details of moving operation in the sheet width direction M and arrangement of the pair of registration rollers 320 will be described later. FIGS. 16A and 17A illustrate a state after the pair of registration rollers 320 is moved in the sheet width direction M with arrangement in which a corner part of the sheet S is not abutted to any of the separated pairs of rollers 340.

In a case that the result of determination in S23 is "NO" (i.e., being unnecessary), the controller 50 starts feeding operation of the sheet S (S25). Subsequently, the sheet S is conveyed to the skew-feeding correcting apparatus 316. As illustrated in FIG. 16A, when the controller 50 stops driving of the pair of registration rollers 320, the top end of the sheet S in the sheet conveyance direction A is abutted to the separated pair of rollers 340 of the pair of registration rollers 320 (S26). The top end of the sheet S at the right side in the sheet conveyance direction A is abutted to the separated pair of rollers 340*g* at the back side of the apparatus body 100A. At that time, since resting torque of the motor 61 (e.g., the stepping motor) is larger than abutting force due to stiffness of the sheets S, the separated pairs of rollers 340 remain stopped and procession of the sheet S is blocked at the part abutted to the separated pair of rollers 340*g*.

Meanwhile, since the sheet S is skew-fed at that time, the sheet S is not abutted yet to the separated pair of rollers 340*b* at the front side of the apparatus in FIG. 16A. Then, with continuous conveying by the pair of pre-registration rollers 115 being the first conveying portion, a loop is formed and the sheet S is also abutted to the separated pair of rollers 340*b* at the front side of the apparatus body 100A where the sheet S has not been abutted, as illustrated in FIGS. 16B and 17B. In this manner, skew feeding of the sheet S is corrected (S27).

The controller 50 rotates the pair of registration rollers 320 thereafter, so that the sheet S is nipped by the pair of the registration rollers 320 as illustrated in FIGS. 16C and 17C (S28). The controller 50 conveys the sheet S to the image transfer portion at the downstream side in the sheet conveyance direction A as maintaining a state that skew feeding of the sheet S is corrected, and then, performs image transferring to the sheet S and discharging operation of the sheet S (S29). Then, the controller 50 ends a series of print jobs (S30). The controller 50 returns the pair of registration rollers 320 to a home position (HP) before being moved in the sheet width direction M (S31).

Figure 20A:
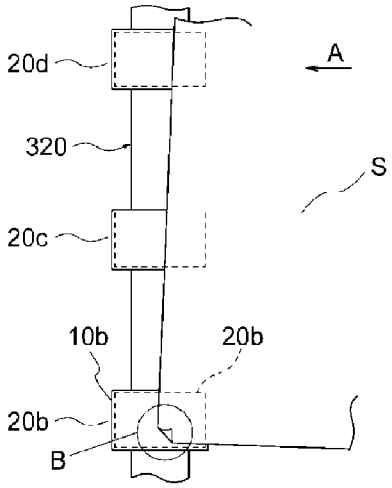
FIG. 20A is a plane view illustrating a hypothetical state in which a corner part of a sheet is abutted to the separated pair of rollers.

FIG. 20A is a plane view illustrating a hypothetical state in which a corner part of the sheet S is abutted to the separated pair of rollers 340. In a case that the pair of registration rollers 320 is not moved in the thrust direction, corner creasing occurs at the corner part of the top end of the sheet S in the sheet conveyance direction A as the corner part of the top end of the sheet S in the sheet conveyance direction A being abutted to the nip of the separated pair of rollers 340 as illustrated in FIG. 20A. According to the third embodiment, such corner creasing at a corner part of the top end of the sheet S is prevented.

Figure 20C:
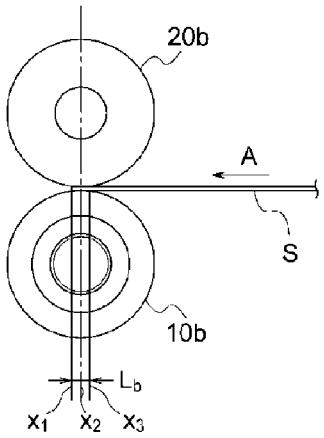
FIG. 20C is a sectional view viewed from arrow D in FIG. 20B.
Figure 20B:
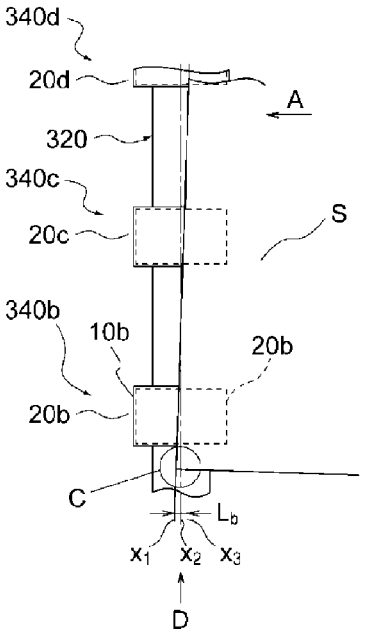
FIG. 20B is a plane view illustrating positional relation between a pair of registration rollers and a skew-fed sheet S in a case that the pair of registration rollers is moved in a thrust direction.

FIG. 20B is a plane view illustrating positional relation between the pair of registration rollers 320 and the skew-fed sheet S in a case that the pair of registration rollers 320 is moved in the thrust direction. FIG. 20C is a sectional view viewed from arrow D in FIG. 20B. As illustrated in FIGS. 20B and 20C, there is a case that the top end of the sheet S in the sheet conveyance direction A is bit by the pair of registration rollers 320 even when the pair of registration rollers 320 is moved in the thrust direction. In the following, such a biting phenomenon of the sheet S will be described (see S26 of FIG. 19).

As illustrated in FIGS. 20B and 20C, according to the skew-feeding correcting apparatus 316, since the pair of registration rollers 320 is moved in the thrust direction, a corner part of the top end of the sheet S will not be abutted to the nip portion of the separated pairs of rollers 340. However, as illustrated in FIG. 20C, there may be a case that a corner part of the top end of the sheet S is abutted to an end face of the separated pair of rollers 340*b* at the vicinity of the corner part of the top end of the sheet S (see area C). At that time, since the sheet S is entered as being skew-fed, entering to the inside of the nip of the separated pair of rollers 340 formed of a rubber roller and a POM roller is more likely to occur compared to a case that the sheet S is abut to a nip line of the separated pair of rollers 340. This is the biting phenomenon.

Normally, in a case that the sheet S is abutted to the pair of registration rollers 320 evenly without being skew-fed, the top end of the sheet S stops at the upstream side ($x_3$) from a registration roller center line ($x_2$) in the sheet conveyance direction A by a thickness amount of the sheet S. A biting amount $L_b$ denoting difference between the stop position $x_3$ and a stop position $x_1$ of the sheet S with biting occurrence depends largely on an entry angle of the sheet S. Even when the sheet S aims for being swung as forming a loop (see S27 in FIG. 19), the biting of the sheet S is unlikely to be released. Accordingly, the sheet S is not to be parallel as following to the nip line of the pair of registration rollers 320, so that sufficient skew-feeding correction is not performed. It is known that the biting amount $L_b$ does not vary so much even when the sheet width varies.

Thus, in a case that a distance between two outermost parts (e.g., a distance between 20*b* and 20*g*) among the plurality of separated pairs of rollers 340 to be abutted is relatively small against the sheet width, influence of the biting becomes large and skew-feeding correcting performance is worsened. That is, there may be a case that a situation adverse to sheet skew-feeding correction occurs depending on the width and arrangement of the separated pairs of rollers 340. To reduce influence of such biting to the extent possible, the width of the separated pair of rollers is set to be smaller than the interval between the adjacent separated pairs of rollers in the third embodiment. Details thereof will be described below.

Figure 20D:
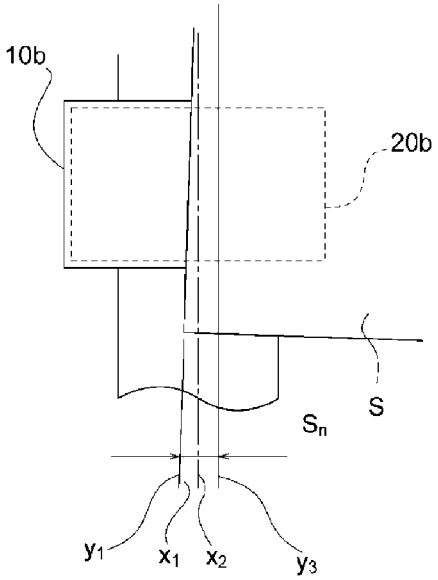
FIG. 20D is an enlarged plane view illustrating positional relation between the separated pair of rollers and the skew-fed sheet.

FIG. 20D is an enlarged plane view illustrating positional relation between the separated pair of rollers 340 and the skew-fed sheet S. As illustrated in FIG. 20D, a corner part of the sheet S at the lower side in FIG. 20D positions at $y_1$ and a corner part of the sheet S at the upper side in FIG. 20D positions at $y_3$. FIG. 20D is utilized for acquiring a below-mentioned equation to derive a sheet skew-feeding amount.

Figure 21:
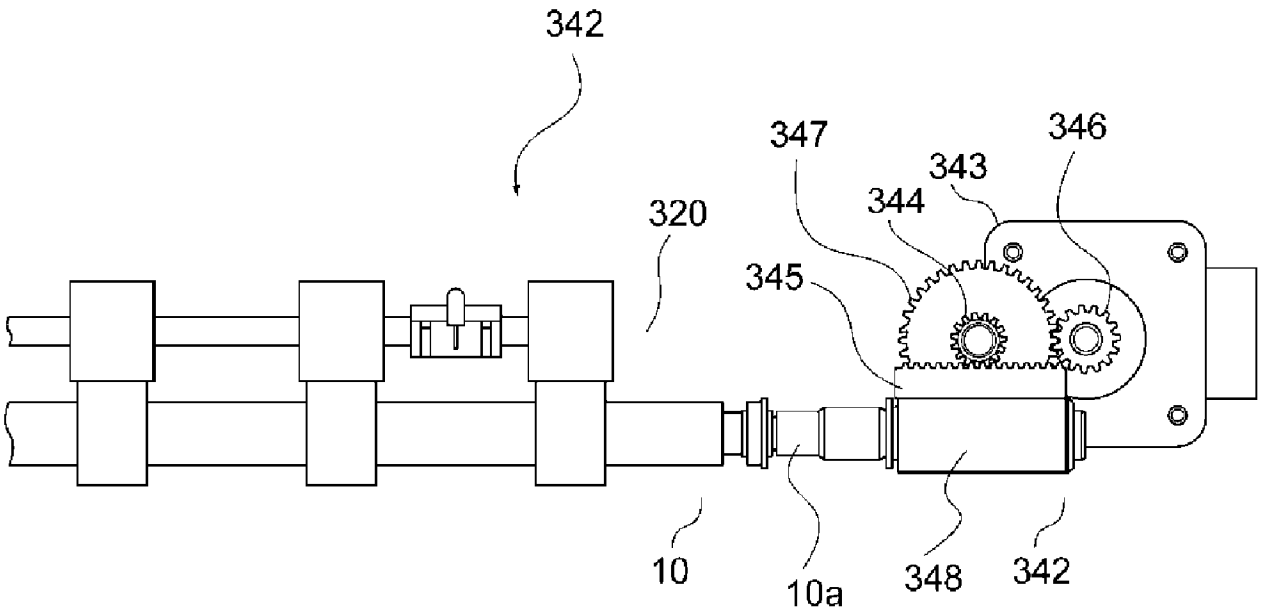
FIG. 21 is a front view illustrating a structure of a horizontal movement apparatus.

FIG. 21 is a front view illustrating a structure of the horizontal movement apparatus 342. FIG. 21 corresponds to a view viewed from the upstream side in the sheet conveyance direction A. In the following, description will be performed on the moving operation and arrangement of the pair of registration rollers 320 in the sheet width direction M being characteristic configuration of the present invention with reference to FIG. 21. When the motor 343 is driven, a gear 346 is rotated and a gear 347 engaged with the gear 346 is rotated. Concurrently, a pinion gear 344 is rotated. Owing to the rotation of the pinion gear 344, a rack 345, a support member 348 and the metal shaft 10*a* are moved in the sheet width direction M.

The rack 345 and the support member 348 are supported so as not to be moved in the sheet width direction M against the drive shaft 41. Thus, with movement of the rack 345 and the support member 348 in the sheet width direction M, the pair of registration rollers 320 can be moved in the sheet width direction M. The metal shaft 10*a* is rotatable at the inside of the support member 348. Here, the teeth width of an idler gear 363 in FIG. 15 is set to be wider than that of a gear 362. This is to maintain rotation of the pair of registration rollers 320 as maintaining gear engagement even when the pair of registration rollers 320 and the gear 62 are moved in the sheet width direction M.

Figures 22A, 22B, 22C:
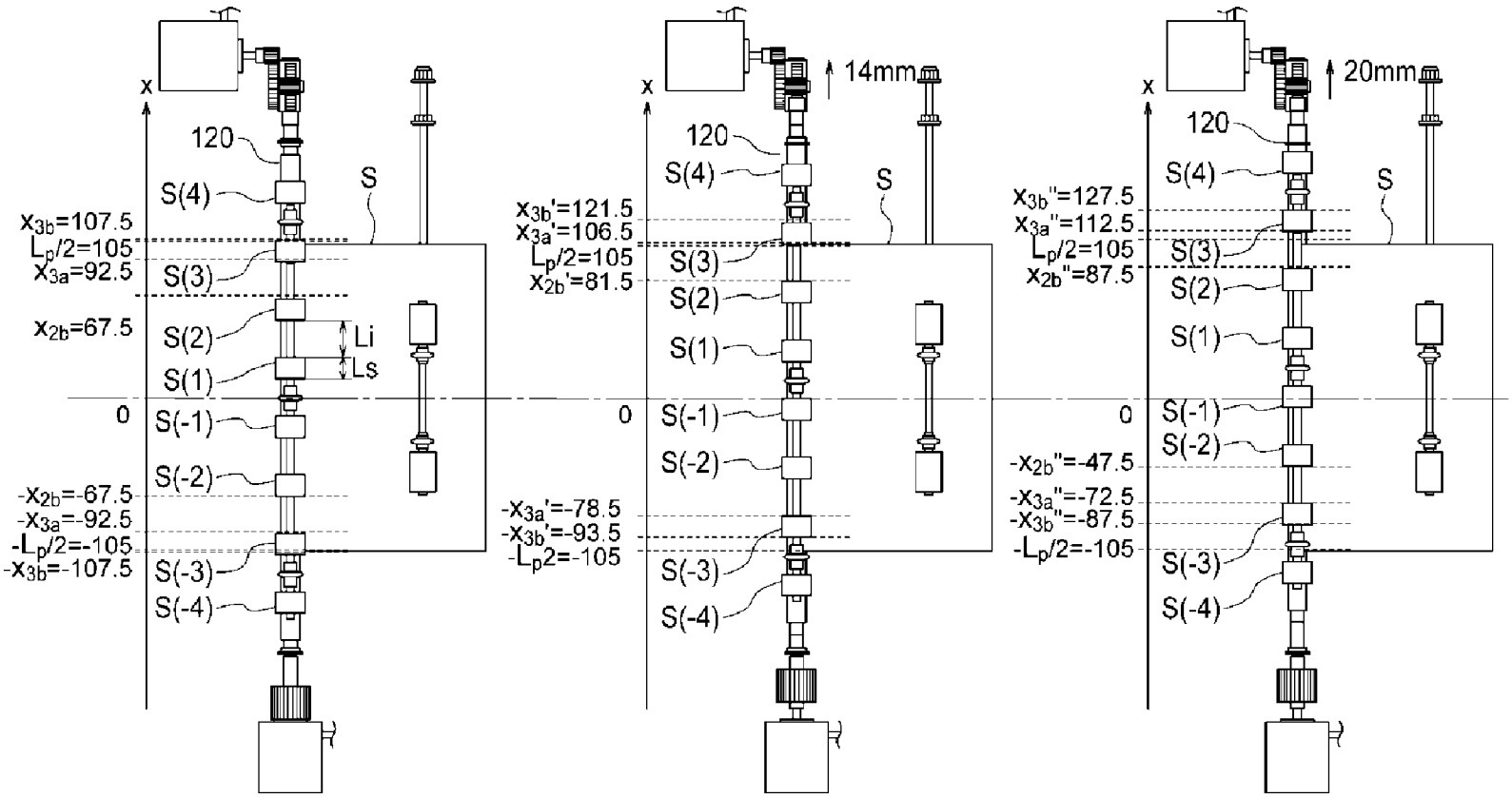
FIGS. 22A to 22C are plane views illustrating positional relation between the separated pairs of rollers and the sheet.

FIGS. 22A to 22C are plane views illustrating positional relation between the pairs of registration rollers 320 and the sheet S. FIG. 22A illustrates a state before the pair of registration rollers 320 is moved in the sheet width direction M and corresponds to a plane view illustrating a state that a corner part of the top end of the sheet S is abutted to the separated pair of rollers 340 of the pair of registration rollers 320. FIG. 22B illustrates a state after the pair of registration rollers 320 is moved in the sheet width direction M and corresponds to a plane view illustrating a state that the corner part of the top end of the sheet S is not abutted to the separated pair of rollers 340 of the pair of registration rollers 320.

Here, description is performed on arrangement in the sheet width direction M and a movement amount in the sheet width direction M of the separated pairs of rollers 340 with reference to FIGS. 22A to 22C. As illustrated in FIGS. 22A and 22B, in the pair of registration rollers 320, the roller width is denoted by $L_s$ and the interval between the adjacent separated pairs of rollers is denoted by $L_i$. The center against the image forming portion is set to be the zero point and the direction toward the back side of the apparatus body 100A is "+x" direction. Here, as an example, an even number of the separated pairs of rollers 340 are arranged having the same $L_s$ and $L_i$. Further, the separated pairs of rollers 340 are arranged being symmetrically shaped against "x=0". Here, the separated pairs of rollers 340*a* to 340*h* are indicated as S(−4) to S(4). End positions of the nth separated pair of rollers 340 from the center are expressed as "$x_{na}=L_i/2+(n-1)(L_s+L_i)$" and "$x_{nb}=x_{na}+L_s$", respectively from the center side. Incidentally, a wide variety of sizes of the sheets S are used for a copying machine. Here, necessity of the movement of the pair of registration rollers 320 in the sheet width direction M is determined owing to whether end positions $L_p/2$ of the sheet S of each size is in a range between $x_{na}$ and $x_{nb}$ as $L_p$ denoting the sheet width. That is, in a case of "$x_{na}<L_p/2<x_{nb}$", the sheet end is to be abutted to the separated pair of rollers 340. Therefore, the pair of registration rollers 320 is required to be moved in the sheet width direction M. Similarly, "$-x_{nb}<-L_p/2<-x_{na}$" is obtained in a case of "x<0".

To prevent abutting of both sheet corner parts from being abutted to any of the separated pairs of rollers 340, the larger value between "$x_{nb}-Lp/_2$" and "$Lp/_2-x_{na}$" is the movement amount in the sheet width direction M required at minimum. Abutting to the separated pairs of rollers 340 is prevented with movement simply by the roller width $L_s$ at maximum. In other words, the minimum widthwise movement amount by which the pair of registration rollers 320 is moved in the width direction M can be described as follows. That is, the minimum widthwise movement amount is an absolute value amount of difference between a position having a larger distance to a corner part of the sheet S in the sheet width direction M out of the positions at both ends of the separated pairs of rollers 340 in the sheet width direction M and a position of the corner part of the sheet S in the sheet width direction M.

Further, to prevent the sheet S from being abutted to the adjacent separated pair of rollers 340 after the pair of registration rollers 320 is moved in the sheet width direction M, the dimension of the separated pairs of rollers 340 in the sheet width direction M is desirably to be small so as to prevent re-abutting even with movement by $L_s$. That is, it is desirable to satisfy "$L_s<L_i$". In other words, the roller width $L_s$ of the separated pairs of rollers 340 is desirably to be smaller than the interval $L_i$ between the adjacent separated pairs of rollers 340.

FIG. 22C illustrates a state after the pair of registration rollers 320 is moved in the sheet width direction M and corresponds to a plane view illustrating a state that the corner part of the top end of the sheet S is not abutted to the separated pair of rollers 340 of the pair of registration rollers 320. As illustrated in FIG. 22C, arrangement after thrust movement causes symmetric abutting of the sheet S against the pair of registration rollers 320 to reduce dependability of skew-feeding correction of the sheet S in the skew-feeding direction of the sheet S to the extent possible. In short, arrangement is performed so that the center line of the sheet S coincides with the center line of any of the separated pairs of rollers 340. Here, the widthwise movement amount is set simply to a half of the pitch of the separated pairs of rollers, that is, to $(L_s+L_i)/2$.

FIG. 23A is a table indicating relation between a separated roller number and separated roller end positions. Here, substance described above with reference to FIGS. 22A to 22C is described with specific numerical values with reference to FIG. 23A. In the pair of registration rollers 320 of FIG. 22A, "$L_s$=15 mm", "$L_i$=25 mm (being larger than $L_s$)", and the separated roller number is to be 8 as being arranged as S(−4) to S(4).

FIG. 23B is a table indicating necessity determination of movement and a movement amount in the sheet width direction M of the pair of registration rollers 320 for each sheet width of sizes of popular sheets S listed therein. As illustrated in FIG. 23B, in a case of A4R (i.e., longitudinal feeding of A4 sheets) for example, corner parts of the sheet S are to be abutted to S(3) and S(−3) at the third separated roller positions from the center. Here, the corner parts of the sheets S can be prevented from being abutted to S(3) and S(−3) by moving the pair of registration rollers 320 in the sheet width direction M by at least 12.5 mm ($=L_p/2-x_{3a}105-92.5$). Either of "+x direction" and "−x direction" may be adopted as the movement direction of the pair of registration rollers 320. For example, in a case of movement in "+x direction" by 12.5 mm, the top end of the sheet S is to be abutted to five pieces of the separated rollers from S(−3) to S(2). In a practical sense, it often happens that variation of the order of 1 to 1.5 mm appears as end position deviation of the sheet S being so-called lateral registration deviation caused by conveyance variation from when the sheet S is fed to when the sheet reaches the pair of registration rollers 320. Therefore, it is also possible that the movement amount in the sheet width direction M is to be 14 mm which is acquired by adding the lateral registration deviation amount to 12.5 mm described above. FIG. 22B illustrates the arrangement of the above. Here, the upper limit value of the movement in the sheet width direction M is to be 27.5 mm ($=-L_p/2-(-x_{3b})+L_i-105-(-107.5)+25$) as satisfying conditions to prevent re-abutting to S(−4).

Alternatively, the movement amount for symmetric arrangement as illustrated in FIG. 22C becomes 20 mm ($(L_s+L_i)/2$) depending only on the arrangement of the separated pairs of rollers 340 without depending on the width of the sheet S.

In a case of the pair of registration rollers 320 having the present structure, the required movement amount in the sheet width direction M depends on $L_s$. That is, the smaller $L_s$ is, the smaller the movement in the sheet width direction M may be. However, in a case that $L_s$ is small, there may be a possibility that the top end of the sheet S receives damage such as an abutment mark owing to concentration of abutment force when the top end of the sheet S is abutted to the pair of registration rollers 320. Therefore, it is desirable that $L_s$ is to be set based on the possible amount of movement in the sheet width direction M and the top end damage.

Next, calculation is performed for skew-feeding amounts at both ends of the sheet S in the sheet width direction M in a case that a constant biting amount occurs at the time of top end abutting. Here, two patterns are compared as the biting amount Lb being 0.5 mm. Abutting of the ends of the sheet S occurs in FIG. 22A. Accordingly, one pattern is a case that S(3) and S(−3) are removed as the arrangement of the separated pairs of rollers 340. In this case, the sheet S is to be abutted to four pieces of separated pairs of rollers 340 from S(−2) to S(2). The other pattern is a case of FIG. 22B in the present embodiment. The calculation is performed as the skew-feeding amounts being S1 and S2 respectively. Here, the skew-feeding amount $S_n$ (see FIG. 20D) is calculated from the biting amount $L_b$ (see FIG. 20B). S1 is calculated to be 0.78 mm ($=L_p/(x_{2b}-(-x_{2b}))\times L_b210/(67.5-(-67.5))\times 0.5$) and S2 is calculated to be 0.6 mm ($=L_p/(x_{2b}'-(-x_{3b}'))\times L_b210/(81.5-(-93.5))\times 0.5$). The skew-feeding amount $S_2$ is proved that amplitude of the biting amount is reduced and that skew feeding is remedied. Further, the smaller $L_s$ and $L_i$ are and the larger the number of the separated pairs of rollers 340 is, the larger the distance between the outermost separated pairs of rollers 340 can be for the sheets S with various widths. Consequently, skew feeding is remedied. Here, abutting positions between the separated pairs of rollers 340 and the sheet S are denoted by $x_1$ and $x_3$ in FIG. 20B and positions of corner parts of the top end of the sheet S are denoted by $y_1$ and $y_3$ in FIG. 20D.

In the description with FIGS. 23A and 23B, typical examples of popular sizes of the sheets S are listed and the required movement amounts in the sheet width direction are calculated therefor. However, the present invention is not limited to the above. Further, the calculation method can be applied similarly to the sheets S such as irregular paper other than regular-sized sheets.

<Fourth Embodiment>

Figure 24:
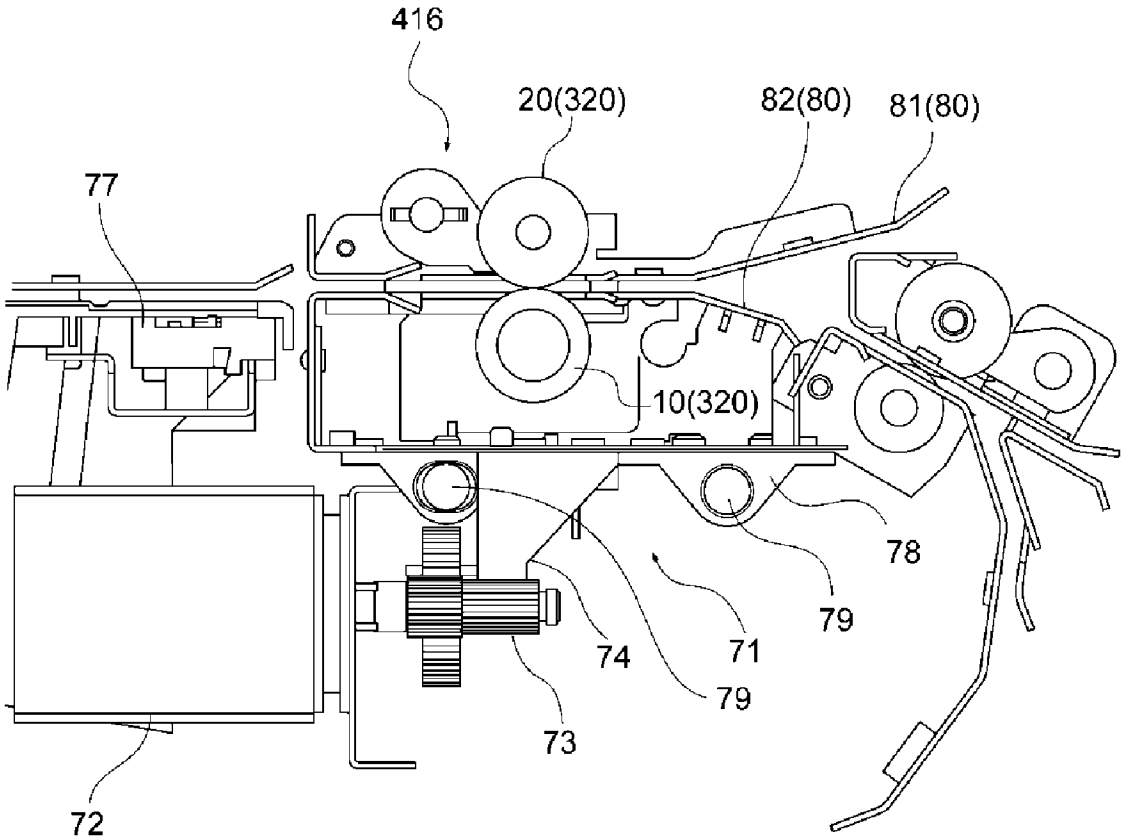
FIG. 24 is an enlarged partial sectional view illustrating a structure of an image forming apparatus including a skew-feeding correcting apparatus according to a fourth embodiment.

FIG. 24 is an enlarged partial sectional view illustrating a structure of an image forming apparatus including a skew-feeding correcting apparatus 416 according to a fourth embodiment. Description on the same structure and effect in the structure of the skew-feeding correcting apparatus 416 of the fourth embodiment as those of the skew-feeding correcting apparatuses of the first to third embodiments will not be repeated appropriately as utilizing the same numeric symbols. Since the fourth embodiment can be also applied to the similar image forming apparatus of the first embodiment, description on the image forming apparatus will not be repeated. The skew-feeding correcting apparatus 416 of the fourth embodiment differs from the skew-feeding correcting apparatus 116,216,316 of the first embodiment as follows.

As illustrated in FIG. 24, the skew-feeding correcting apparatus 416 includes the shift unit 71. The shift unit 71 includes the support member 78 which collectively supports the pair of registration rollers 320 and the conveying guide 80. Further, the shift unit 71 includes the pinion gear 73 which moves the support member 78 in the sheet width direction M and the motor 72 which rotates the pinion gear 73. The support member 78 is provided with the rack 78 to be engaged with the pinion gear 73. The support member 78 is supported movably in the sheet width direction M owing to the two guide shafts 79 extended in the sheet width direction M. According to the above structure, the shift unit 71 moves the pair of registration rollers 320 and the conveying guide 80 integrally in the sheet width direction M.

Further, the skew-feeding correcting apparatus 416 includes a line sensor 77 as the end position detection portion. The line sensor 77 being placed at the downstream side from the pair of registration rollers 320 in the sheet conveyance direction A detects a positional deviation amount as the end of the sheet S in the sheet width direction M. Further, the skew-feeding correcting apparatus 416 includes the controller 50. The controller 50 moves the pair of registration rollers 320 in the sheet width direction M based on a detection result of the line sensor 77, so that positional deviation of the end of the sheet S is corrected. Other features such as the basic structure for skew-feeding correction, necessity determination of movement of the pair of registration rollers 320 in the sheet width direction M, and the movement amount of the pair of registration rollers 320 in the sheet width direction M to prevent sheet corner parts from being abutted to the pair of registration rollers 320 are the same as those of the first embodiment.

When the controller 50 drives the motor 72, the pinion gear 73 is rotated and the rack 74 is moved in the sheet width direction M by a specified amount. Thus, the pair of registration rollers 320 and the conveying guide 80 are integrally moved in the sheet width direction M without varying relative positions thereof. In a case that a structure in which the pair of registration rollers 320 and the conveying guide 80 can be moved separately in the sheet width direction M, flexibility of arrangement of the pair of registration rollers 320 and the conveying guide 80 is impaired. In this case, there arises an issue such that the separated pairs of rollers 340 of the pair of registration rollers 320 cannot be moved in the sheet width direction M unless dimensions in the sheet width direction M of the cutout 81*a* and the cutout 82*a* of the conveying guide 80 are enlarged. In the fourth embodiment, since the pair of registration rollers and the conveying guide are structured to be integrally moved, flexibility of arrangement is improved.

In addition to the skew-feeding correction by the pair of registration rollers 320, the skew-feeding correcting apparatus 416 illustrated in FIG. 24 corrects image position deviation in the sheet width direction M perpendicular to the sheet conveyance direction A (i.e., the lateral registration correction). In the following, general operation of the skew-feeding correcting apparatus 416 will be described. First, at the time of starting printing, the pair of registration rollers 320 is moved in the sheet width direction M by the shift unit 71 corresponding to a size of the sheet S, as being similar to the third embodiment. That is, the position of the pair of registration rollers 320 in the sheet width direction M is adjusted so that the sheet corner part is not abutted to the pair of registration rollers 320 before the sheet top end abuts the pair of registration rollers 320. Then, skew feeding of the sheet is corrected as the sheet being abutted to the pair of registration rollers 320. The sheet of which skew feeding is corrected is nipped and conveyed by the pair of registration rollers 320. During sheet conveyance by the pair of registration rollers 320, the line sensor (e.g., a CIS) 77 placed at the downstream side in the sheet conveyance direction A detects a lateral end position of the sheet S. The controller 50 derives difference against the image end position due to the image forming portion 51 as the lateral registration correction amount. The lateral registration correction can be performed in high accuracy as the pair of registration rollers 320 being moved in the sheet width direction M by the lateral registration correction amount in a state that the sheet S is nipped by the pair of registration rollers 320.

In the above description of the first to fourth embodiments, the sheet S is skew-fed to the left direction as illustrated in FIGS. 4 and 16. Similarly, sheet skew feeding correction is performed in a case that the sheet S is skew-fed to the opposite direction (i.e., to the right direction) as well. Further, description is performed with specific values as shape dimensions of the shutter 121. However, the present invention is not limited to the above numerical values. Further, description is performed with the image forming apparatus of an electrophotographic system as an example. However, the skew-feeding correcting operation can be performed similarly with another image forming apparatus such as an ink-jet system, for example.

According to the structure of the first to fourth embodiments, it is possible to suppress a phenomenon that a skew-feeding correction error occurs with corner creasing of a sheet S caused by buckling when the sheet S is abutted to the abutment pieces 40 or the separated pairs of rollers 340. That is, it is possible to have the structure in which corner parts of the sheet S are prevented from being abutted to the abutment pieces 40 of the shutter 121 corresponding to the sheets S having various sheet widths including irregular sizes. Consequently, corner creasing of the sheets S and jamming of the sheets S can be suppressed. In addition, performance of the skew-feeding correction of the sheets S is improved.

Here, when the width of the abutment pieces 40 of the shutter 121 in the sheet width direction M is appropriate, occurrence of an abutment mark and the like at the top end of the sheet S can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279228, filed Dec. 15, 2010, No. 2011-255333, filed Nov. 22, 2011 which are hereby incorporated by reference herein in their entirety.

What is claimed is:

1. A skew-feeding correcting apparatus, comprising:

a plurality of abutment portions which is disposed to a conveying path to convey a sheet and to which a top end of the sheet is abutted to correct skew feeding of the sheet;

a movement portion which moves the abutment portions in a sheet width direction perpendicular to a sheet conveyance direction; and a controller which controls driving of the movement portion to move the abutment portions to each position where a corner part of the sheet is not to be abutted to any of the abutment portions before the top end of the sheet is abutted to the abutment portions.

2. The skew-feeding correcting apparatus according to claim 1, further comprising:

a sheet storage portion which stores a sheet; and a size detection portion which detects a size of the sheet in the sheet storage portion, wherein the controller calculates a movement amount of the abutment portions in the sheet width direction based on information of sheets dimension in the sheet width direction detected by the size detection portion and information of positions of the abutment portions.

3. The skew-feeding correcting apparatus according to claim 1, wherein the controller memorizes a table in which a sheet type and a movement amount of the abutment portions are associated, the movement amount of the abutment portions is acquired corresponding to the sheet type, and controls driving of the movement portion so that the abutment portions are moved by the movement amount.

4. The skew-feeding correcting apparatus according to claim 1, wherein the abutment portions are abutment pieces which block the conveying path and to which the top end of the sheet is abutted.

5. The skew-feeding correcting apparatus according to claim 4, wherein width of each abutment piece is smaller than an interval between the adjacent abutment pieces.

6. The skew-feeding correcting apparatus according to claim 4, wherein a minimum amount of a movement amount in the width direction which the abutment pieces move is an absolute value amount of difference between a position having a larger distance to a corner part of the sheet top end out of positions at both ends of the abutment pieces in the sheet width direction and a position of the corner part of the sheet top end.

7. The skewing-feeding correcting apparatus according to claim 1, further comprising:

a conveying portion which conveys the sheet in the sheet conveyance direction;

a sheet conveying guide; and a support member which collectively supports the abutment portions, the sheet conveying guide, and the conveying portion, wherein the movement portion moves the abutment portions, the sheet conveying guide, and the conveying portion integrally in the sheet width direction by moving the support member.

8. The skew-feeding correcting apparatus according to claim 1, further comprising an end position detection portion which is disposed to a downstream side of the abutment portions in the sheet conveyance direction and which detects a positional deviation amount of an end part of the sheet in the sheet width direction;

wherein the controller controls driving of the movement portion based on a detection result of the end position detection portion so as to correct positional deviation of an end part of the sheet being conveyed.

9. The skew-feeding correcting apparatus according to claim 1, wherein the abutment portions are pairs of separated rollers to which the top end of the sheet is abutted at each nip portion.

10. An image forming apparatus, comprising:

an image forming portion which forms an image;

a plurality of abutment portions which is disposed to a conveying path to convey a sheet and to which a top end of the sheet is abutted to correct skew feeding of the sheet;

a movement portion which moves the abutment portions in a sheet width direction perpendicular to a sheet conveyance direction; and a controller which controls driving of the movement portion to move the abutment portions to each position where a corner part of the sheet is not to be abutted to any of the abutment portions before the top end of the sheet is abutted to the abutment portions.

* * * * *